US010435192B2

(12) United States Patent
Luciano, Jr. et al.

(10) Patent No.: US 10,435,192 B2
(45) **Date of Patent: *Oct. 8, 2019**

(54) MULTIPLE INSPECTION SYSTEM AND METHOD THAT INSPECTS DIFFERENT MEDICATIONS

(71) Applicant: Edge Medical Properties, LLC, Reno, NV (US)

(72) Inventors: Robert A. Luciano, Jr., Reno, NV (US); Warren White, Reno, NV (US)

(73) Assignee: EDGE MEDICAL PROPERTIES, LLC, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/077,729

(22) Filed: Mar. 22, 2016

(65) Prior Publication Data

US 2017/0275035 A1 Sep. 28, 2017

Related U.S. Application Data

(63) Continuation of application No. 13/473,304, filed on May 16, 2012, now Pat. No. 9,334,096.
(Continued)

(51) Int. Cl.
*B65B 57/10* (2006.01)
*B65B 1/46* (2006.01)
*B65B 25/00* (2006.01)

(52) U.S. Cl.
CPC ..... *B65B 57/10* (2013.01); *B65B 1/46* (2013.01); *B65B 25/00* (2013.01); *B65B 2220/14* (2013.01)

(58) Field of Classification Search
CPC .. B65B 57/10; B65B 1/46; B65B 1/48; B65B 1/30; B65B 1/04; B65B 1/00;
(Continued)

(56) References Cited

U.S. PATENT DOCUMENTS 2,294,220 A 8/1942 Albertson
3,126,129 A 3/1964 Weinberg
(Continued)

FOREIGN PATENT DOCUMENTS

DE 3502647 A1 7/1986
WO 9613790 A 5/1996
(Continued)

*Primary Examiner* — Toan M Le
(74) *Attorney, Agent, or Firm* — Kerr IP Group, LLC

(57) ABSTRACT

A multiple inspection system and method that inspects packages filled with at least two different medications that are to be consumed by a patient is described. The method includes filling each package with the at least two different medications. A package that is to be inspected is selected by a process control module. A first automated inspection examines the different medications with a first measurement device. A first measurement result is generated. A first automated inspection result is generated by comparing a first expected inspection value with the first measurement result. A second automated inspection having a second measurement device generates a second measurement result. A second automated inspection result is generated by comparing a second expected inspection value with the second measurement result. An analytical module then proceeds to compare the first automated inspection result and the second automated inspection result.

20 Claims, 13 Drawing Sheets

Related U.S. Application Data

(60) Provisional application No. 61/486,427, filed on May 16, 2011, provisional application No. 61/486,436, filed on May 16, 2011, provisional application No. 61/498,489, filed on Jun. 17, 2011.

(58) Field of Classification Search
CPC .... B65B 43/12; G01N 21/9508; G01N 21/95; G01N 21/90; G01N 21/892; G01N 21/8901; G01N 21/8806; G01N 21/8803
See application file for complete search history.

(56) References Cited

U.S. PATENT DOCUMENTS 3,254,828 A 6/1966 Hershey
3,308,962 A 3/1967 Bryant
3,409,721 A 11/1968 Norman
3,410,450 A 11/1968 Fortenberry
3,432,951 A 3/1969 Phil
3,450,306 A 6/1969 Gill
3,497,982 A 3/1970 Schulz
3,503,493 A 3/1970 Nagy
3,703,955 A 11/1972 Inacker
3,773,250 A 11/1973 Phillips
3,780,856 A 12/1973 Braverman
3,809,220 A 5/1974 Arcudi
3,881,625 A 5/1975 James
3,884,379 A 5/1975 James
3,921,804 A 11/1975 Tester
3,933,245 A 1/1976 Mullen
4,036,385 A 7/1977 Morris
4,039,080 A 8/1977 Cappuccilli
4,062,445 A 12/1977 Moe
4,274,550 A 6/1981 Feldstein
4,318,477 A 3/1982 Kerpe
4,416,375 A 11/1983 Braverman et al.
4,512,476 A 4/1985 Herrington
4,535,890 A 8/1985 Artusi
4,546,901 A 10/1985 Buttarazzi
4,553,670 A 11/1985 Collens
4,635,890 A 1/1987 Matsuda et al.
4,655,026 A 4/1987 Wigoda
4,693,371 A 9/1987 Malpass
4,736,849 A 4/1988 Leonard et al.
4,749,085 A 6/1988 Denney
4,799,590 A 1/1989 Furman
4,805,800 A 2/1989 Nocek et al.
4,811,764 A 3/1989 McLaughlin
4,832,229 A 5/1989 Hackmann et al.
4,850,489 A 7/1989 Weithmann et al.
4,860,899 A 8/1989 McKee
4,867,315 A 9/1989 Baldwin
4,872,559 A 10/1989 Schoon
4,887,790 A 12/1989 Wilkinson et al.
4,918,604 A 4/1990 Baum
4,953,745 A 9/1990 Rowlett
4,972,657 A 11/1990 McKee
5,014,851 A 5/1991 Wick
5,027,954 A 7/1991 Hickerson
5,085,510 A 2/1992 Mitchell
5,186,345 A 2/1993 An
5,195,123 A 3/1993 Clement
5,199,636 A 4/1993 Young
5,310,057 A 5/1994 Caldwell et al.
5,366,087 A 11/1994 Bane
5,390,796 A 2/1995 Kerfoot
5,422,831 A 6/1995 Misra et al.
5,457,895 A 10/1995 Thompson et al.
5,505,371 A 4/1996 O'Neill
5,522,512 A 6/1996 Archer et al.
5,544,768 A 8/1996 Gargione
5,558,229 A 9/1996 Halbich
5,577,612 A 11/1996 Chesson et al.
5,597,995 A 1/1997 Williams et al.
5,638,657 A 6/1997 Archer et al.
5,642,906 A 7/1997 Foote et al.
5,671,592 A 9/1997 Yuyama et al.
5,711,442 A 1/1998 Kusz
5,737,539 A 4/1998 Edelson et al.
5,743,815 A 4/1998 Helderman
5,746,323 A 5/1998 Dragotta
5,788,079 A 8/1998 Bouthiette
5,788,974 A 8/1998 Maida
D400,412 S 11/1998 Gold
5,873,466 A 2/1999 Hulick
5,878,887 A 3/1999 Parker et al.
5,883,370 A 3/1999 Walker et al.
5,899,333 A 5/1999 Williams et al.
5,921,398 A 7/1999 Carroll
5,941,402 A 8/1999 Krueger
5,963,453 A 10/1999 East
5,995,938 A 11/1999 Whaley
6,012,582 A 1/2000 Haygeman et al.
6,021,392 A 2/2000 Lester et al.
6,021,623 A 2/2000 Bouthiette
6,023,916 A 2/2000 Bouthiette
6,066,374 A 5/2000 Healy et al.
6,068,156 A 5/2000 Liff et al.
6,077,530 A 6/2000 Weinstein et al.
6,115,996 A 9/2000 Yuyama et al.
6,129,211 A 10/2000 Prakken et al.
6,155,423 A 12/2000 Katzner et al.
6,155,485 A 12/2000 Coughlin et al.
6,170,230 B1 1/2001 Chudy et al.
6,176,392 B1 1/2001 William et al.
6,181,979 B1 1/2001 Murakami
6,202,923 B1 3/2001 Boyer et al.
6,227,371 B1 5/2001 Song
6,273,260 B1 8/2001 ColDepietro et al.
6,293,403 B1 9/2001 Holmberg
6,308,494 B1 10/2001 Yuyama et al.
6,317,648 B1 11/2001 Sleep et al.
6,318,630 B1 11/2001 Coughlin et al.
6,324,253 B1 11/2001 Yuyama et al.
6,330,351 B1 12/2001 Yasunaga
6,343,695 B1 2/2002 Petrick et al.
D455,057 S 4/2002 Medhurst
6,371,297 B1 4/2002 Cha
6,375,956 B1 4/2002 Hermelin et al.
6,378,572 B1 4/2002 Neubauer et al.
6,401,919 B1 6/2002 Griffis et al.
6,449,921 B1 9/2002 Kim
6,449,927 B2 9/2002 Hebron et al.
6,460,693 B1 10/2002 Harrold
6,505,461 B1 1/2003 Yasunaga
6,523,694 B2 2/2003 Lux et al.
6,527,138 B2 3/2003 Pawlo et al.
6,535,637 B1 3/2003 Wootton et al.
6,564,945 B1 5/2003 Weinstein et al.
6,581,798 B2 6/2003 Liff et al.
6,594,928 B1 7/2003 Clawson et al.
6,611,733 B1 8/2003 Huerga
6,662,081 B1 12/2003 Jacober et al.
6,681,935 B1 1/2004 Lewis
6,690,998 B1 2/2004 Yuyama
6,711,460 B1 3/2004 Reese
6,735,497 B2 5/2004 Wallace et al.
6,738,723 B2 5/2004 Hamilton
6,757,898 B1 6/2004 Ilsen et al.
6,771,369 B2 8/2004 Rzasa et al.
6,839,403 B1 1/2005 Kotowski et al.
6,892,512 B2 5/2005 Rice et al.
6,925,774 B2 8/2005 Peterson
6,962,266 B2 11/2005 Morgan et al.
6,971,541 B2 12/2005 Williams et al.
6,981,592 B2 1/2006 Siegel
7,006,893 B2 2/2006 Hart et al.
7,010,899 B2 3/2006 McErlean et al.
7,017,513 B2 3/2006 Giewercer
7,017,748 B2 3/2006 Weinstein
7,028,723 B1 4/2006 Alouani et al.
7,055,294 B1 6/2006 Lewis
7,089,131 B2 8/2006 Thouin et al.
7,111,780 B2 9/2006 Broussard et al.

(56) References Cited

U.S. PATENT DOCUMENTS 7,185,476 B1 3/2007 Siegel et al.
7,225,597 B1 6/2007 Knoth
7,398,279 B2 7/2008 Muno et al.
7,426,814 B2 9/2008 Knoth
7,509,787 B2 3/2009 Ballestrazzi et al.
7,668,730 B2 2/2010 Reardan et al.
7,672,859 B1 3/2010 Louie et al.
7,747,345 B2 6/2010 Ohmura et al.
7,766,766 B2 8/2010 Savarese et al.
7,828,148 B2 11/2010 Gibson
7,894,656 B2 2/2011 Kim
7,942,280 B2 5/2011 Priebe et al.
7,942,451 B2 5/2011 Adler
7,946,421 B2 5/2011 Kowalik et al.
8,020,702 B2 9/2011 Strub et al.
8,041,102 B2 10/2011 Yuyama et al.
8,055,512 B1 11/2011 Pankow et al.
8,074,426 B2 12/2011 Luciano et al.
8,120,540 B1 2/2012 Armstrong
8,122,849 B2 2/2012 Clarke et al.
8,123,036 B2 2/2012 Luciano et al.
8,146,747 B2 4/2012 Luciano et al.
8,196,774 B1 6/2012 Clarke et al.
8,266,878 B2 9/2012 Luciano et al.
8,556,077 B1 10/2013 Hanley
8,712,582 B1 4/2014 Luciano et al.
8,713,897 B2 5/2014 Luciano et al.
8,727,208 B2 5/2014 Poisner
8,752,704 B2 6/2014 Alonso et al.
8,777,012 B2 7/2014 Luciano et al.
8,789,700 B2 7/2014 Luciano et al.
8,914,298 B1 12/2014 Luciano
8,931,241 B2 1/2015 Luciano et al.
8,972,288 B2 3/2015 Luciano
9,334,096 B2 * 5/2016 Luciano, Jr. ..... B65D 75/36
2001/0017023 A1 8/2001 Armington et al.
2001/0041968 A1 11/2001 Hamilton
2002/0029223 A1 3/2002 Rice et al.
2002/0042725 A1 4/2002 Mayaud
2002/0047019 A1 4/2002 Devers
2002/0066691 A1 6/2002 Varon
2002/0099467 A1 7/2002 Sleep et al.
2002/0104778 A1 8/2002 Lux et al.
2002/0117405 A1 8/2002 Wang et al.
2003/0012701 A1 1/2003 Sangha et al.
2003/0018495 A1 1/2003 Sussman
2003/0136698 A1 7/2003 Klatt
2003/0142784 A1 7/2003 Suzuki et al.
2003/0174326 A1 9/2003 Rzasa et al.
2003/0176942 A1 9/2003 Sleep et al.
2003/0193185 A1 10/2003 Valley et al.
2003/0200726 A1 10/2003 Rast
2003/0209461 A1 11/2003 French et al.
2004/0011806 A1 1/2004 Luciano et al.
2004/0011961 A1 1/2004 Platt et al.
2004/0045863 A1 3/2004 Rhoades
2004/0069674 A1 4/2004 Siegel
2004/0069675 A1 4/2004 Stevens
2004/0088187 A1 5/2004 Chudy et al.
2004/0094050 A1 5/2004 Ackley et al.
2004/0122713 A1 6/2004 Hill et al.
2004/0123564 A1 7/2004 McErlean et al.
2004/0140241 A1 7/2004 Weinstein
2004/0158507 A1 8/2004 Meek et al.
2004/0162634 A1 8/2004 Rice et al.
2004/0172295 A1 9/2004 Dahlin et al.
2004/0188312 A1 9/2004 Stepowany
2004/0188998 A1 9/2004 Henthorn
2004/0217038 A1 11/2004 Gibson
2004/0225528 A1 11/2004 Brock
2004/0243445 A1 12/2004 Keene
2004/0249591 A1 12/2004 Trebbi
2004/0251157 A1 12/2004 Behnke et al.
2004/0256277 A1 12/2004 Gedanke
2004/0260424 A1 12/2004 Mahar
2004/0268413 A1 12/2004 Reid et al.
2005/0021367 A1 1/2005 Saeger et al.
2005/0044762 A1 3/2005 Atluri
2005/0049746 A1 3/2005 Rosenblum
2005/0049747 A1 3/2005 Willoughby et al.
2005/0060197 A1 3/2005 Mayaud
2005/0061825 A1 3/2005 Willoughby et al.
2005/0144038 A1 6/2005 Tamblyn et al.
2005/0171813 A1 8/2005 Jordan
2005/0209879 A1 9/2005 Chalmers
2005/0218152 A1 10/2005 Simon
2005/0269817 A1 12/2005 Alasia et al.
2006/0045323 A1 3/2006 Ateya
2006/0064670 A1 3/2006 Linebarger et al.
2006/0065670 A1 3/2006 Doublet et al.
2006/0076262 A1 4/2006 Bassett
2006/0086640 A1 4/2006 Luciano et al.
2006/0122729 A1 6/2006 Murphy et al.
2006/0124502 A1 6/2006 Lee
2006/0163269 A1 7/2006 Anderson et al.
2006/0163869 A1 7/2006 Adler et al.
2006/0213816 A1 9/2006 Jorritsma
2006/0219595 A1 10/2006 Peters
2007/0000805 A1 1/2007 Brink
2007/0131576 A1 6/2007 Ehling et al.
2007/0150219 A1 6/2007 Cawker et al.
2007/0168228 A1 7/2007 Lawless
2007/0169838 A1 7/2007 Yuyama et al.
2007/0173971 A1 7/2007 Richardson et al.
2007/0210164 A1 9/2007 Conlon et al.
2007/0228047 A1 10/2007 Pehr et al.
2007/0235369 A1 10/2007 Perell
2007/0241987 A1 10/2007 Kish et al.
2008/0000979 A1 1/2008 Poisner
2008/0059228 A1 3/2008 Bossi et al.
2008/0110131 A1 5/2008 Kim
2008/0142400 A1 6/2008 Arnold
2008/0149657 A1 6/2008 Kim
2008/0190076 A1 8/2008 Klingel et al.
2008/0228160 A1 9/2008 Harrison
2009/0119129 A1 5/2009 Nadas et al.
2009/0133362 A1 5/2009 Bentele et al.
2009/0139893 A1 6/2009 McGonagle et al.
2009/0230013 A1 9/2009 Born et al.
2010/0069213 A1 3/2010 Luciano et al.
2010/0089936 A1 4/2010 Luciano et al.
2010/0100391 A1 4/2010 Daya et al.
2010/0139222 A1 6/2010 Federle et al.
2010/0147734 A1 6/2010 Luciano et al.
2010/0175352 A1 7/2010 Soloman
2010/0265072 A1 10/2010 Goetz et al.
2010/0287880 A1 11/2010 Yasunaga et al.
2010/0324728 A1 12/2010 Rosenblum
2011/0036856 A1 2/2011 Ooyen et al.
2011/0040572 A1 2/2011 Chmiel et al.
2011/0100863 A1 5/2011 Luciano
2011/0101016 A1 5/2011 Luciano
2011/0157342 A1 6/2011 Kim
2011/0161097 A1 6/2011 Fox et al.
2011/0251850 A1 10/2011 Stephens
2011/0264465 A1 10/2011 Lindsay
2012/0022893 A1 1/2012 Findlay et al.
2012/0089416 A1 4/2012 Luciano
2012/0097560 A1 4/2012 Contractor
2012/0116579 A1 5/2012 Shows et al.
2012/0123907 A1 5/2012 Luciano
2012/0158430 A1 6/2012 MacDonald
2012/0186693 A1 7/2012 Luciano et al.
2012/0200596 A1 8/2012 Gotou et al.
2012/0290129 A1 11/2012 Luciano et al.
2012/0293623 A1 11/2012 Nygaard
2012/0296592 A1 11/2012 Luciano et al.
2012/0312714 A1 12/2012 Luciano et al.
2013/0161207 A1 6/2013 Luciano et al.
2014/0002631 A1 1/2014 Amano et al.

(56) References Cited

U.S. PATENT DOCUMENTS

FOREIGN PATENT DOCUMENTS

| | | | |
|---|---|---|---|
| WO | 2004082561 | A1 | 9/2004 |
| WO | 2005102841 | A1 | 11/2005 |
| WO | 2011080462 | A1 | 7/2011 |

* cited by examiner

700

| Case | Inspection Result #1 (702) | Inspection Result #2 (704) | Manual Inspection (706) | Correction Required (708) |
|---|---|---|---|---|
| 1 | Good | Good | NO | NO |
| 2 | Good | Bad | YES | Determined by Manual Inspection |
| 3 | Bad | Good | YES | Determined by Manual Inspection |
| 4 | Bad | Bad | NO | YES |
| 5 | Good | Inconclusive | NO | NO |
| 6 | Bad | Inconclusive | NO | YES |
| 7 | Inconclusive | Good | NO | NO |
| 8 | Inconclusive | Bad | NO | YES |

Figure 10

MULTIPLE INSPECTION SYSTEM AND METHOD THAT INSPECTS DIFFERENT MEDICATIONS

CROSS REFERENCE

This patent application is a continuation of U.S. patent application Ser. No. 13/473,304 entitled MULTIPLE INSPECTION SYSTEM AND METHOD THAT INSPECTS DIFFERENT MEDICATIONS, filed May 16, 2012 that claims the benefit of provisional patent application 61/486,427 entitled INSPECTION SYSTEM AND METHOD WITH A CONTROL PROCESS THAT INSPECTS DIFFERENT MEDICATIONS and provisional patent application 61/486,436 entitled MULTIPLE INSPECTION SYSTEM AND METHOD THAT INSPECTS DIFFERENT MEDICATIONS, both filed on May 16, 2011 and provisional patent application 61/498,489 filed on Jun. 17, 2011, all applications listed are hereby incorporated by reference.

FIELD

This description relates to a multiple inspection system and method that inspects different medications. More particularly, the description relates to analyzing the results from multiple automated inspections of different medications in a package.

BACKGROUND

Patients struggle with remembering which medications to take and when to take them. This is particularly a problem for the elderly or infirm. Additionally, the more severe the medical problem, the more challenging it is to take medications properly. To address this problem various manual devices exist that have multiple compartments that patients (or their care-givers) pre-populate with medications corresponding to various dosing periods. Although this helps reduce errors, the containers are unwieldy and still prone to filling errors.

Automated filling machines have been developed to combine medications into a single pouch or blister that, in turn, are connected to other pouches or containers. Some automated filling machines are capable of filling packages with a variety of different pharmaceuticals or nutraceuticals that are consumed by a patient at the same time. Some patients may have multiple packages or containers that are associated with multiple dosing periods during the day. For example, there may be a group of tablets that are consumed before breakfast in one container, another container may have a group of medications that are to be consumed with lunch, and yet another group of medications that are to be taken before going to bed.

Generally, automated tablet inspection is limited in scope (normally to a single tablet type) and in other cases fail to accurately confirm the proper medication when a multiplicity of medications are placed in a single package or container.

The problem with using most technically and financially viable automated inspection techniques is that the uncertainty percentage is generally unacceptably high, causing a prohibitively expensive and slow manual inspection process to be invoked.

Although it may be seen that packaging multiple medications into containers that hold all medications to be consumed at the same time is a desirable product, large scale implementations have been limited by the lack of a sufficiently reliable and cost-effect way of automatically inspecting filled containers to assure that they are properly filled.

Thus, it would be beneficial to accurately fill containers having a variety of different medications or supplements. Additionally, compliance with a regimen of medication or supplements is challenging for patients having difficulty remembering when a dose has been consumed. The problem is exacerbated by the number of tablets being consumed increasing as the patient ages.

SUMMARY

A multiple inspection system and method that inspects packages filled with at least two different medications that are to be consumed by a patient is described. The method includes filling each package with the at least two different medications with a filling station that is configured to associate at least one package with the patient. The method then proceeds to selecting each package that is to be inspected with a process control module that is communicatively coupled to the filling station. A first automated inspection is initiated by examining the different medications with a first measurement device that is associated with a first inspection property. Subsequently, a first measurement result is generated. The method then proceeds to determine a first automated inspection result by comparing a first expected inspection value with the first measurement result.

A second automated inspection is initiated by examining the different medications with a second measurement device that is associated with a second inspection property. A second measurement result is generated. The method then proceeds to determine a second automated inspection result by comparing a second expected inspection value with the second measurement result.

An analytical module then compares the first automated inspection result and the second automated inspection result for at least one package. The analytical module configured to select one of a plurality of post-inspection states that is communicated to the process control module.

In one embodiment, the process control module determines where to convey each package—manual inspection station state, the correction station state, and the assembly station state. Additionally, the process control module may control a conveyor located between the first automated inspection and the second automated inspection.

The post-inspection states include a manual inspection station, a correction station, and an assembly station. In one embodiment, an instruction from the process control module that the package was improperly filled results in conveying the package to the manual inspection station and then conveying the package to one of the correction station and the assembly station. In another embodiment, the improperly filled instruction conveys the package to the correction station and then the assembly station. In yet another embodiment, a properly filled instruction is received by the process control module, and the package is conveyed to the assembly station.

DRAWINGS

The present invention will be more fully understood by reference to the following drawings which are for illustrative, not limiting, purposes.

Figure 8:
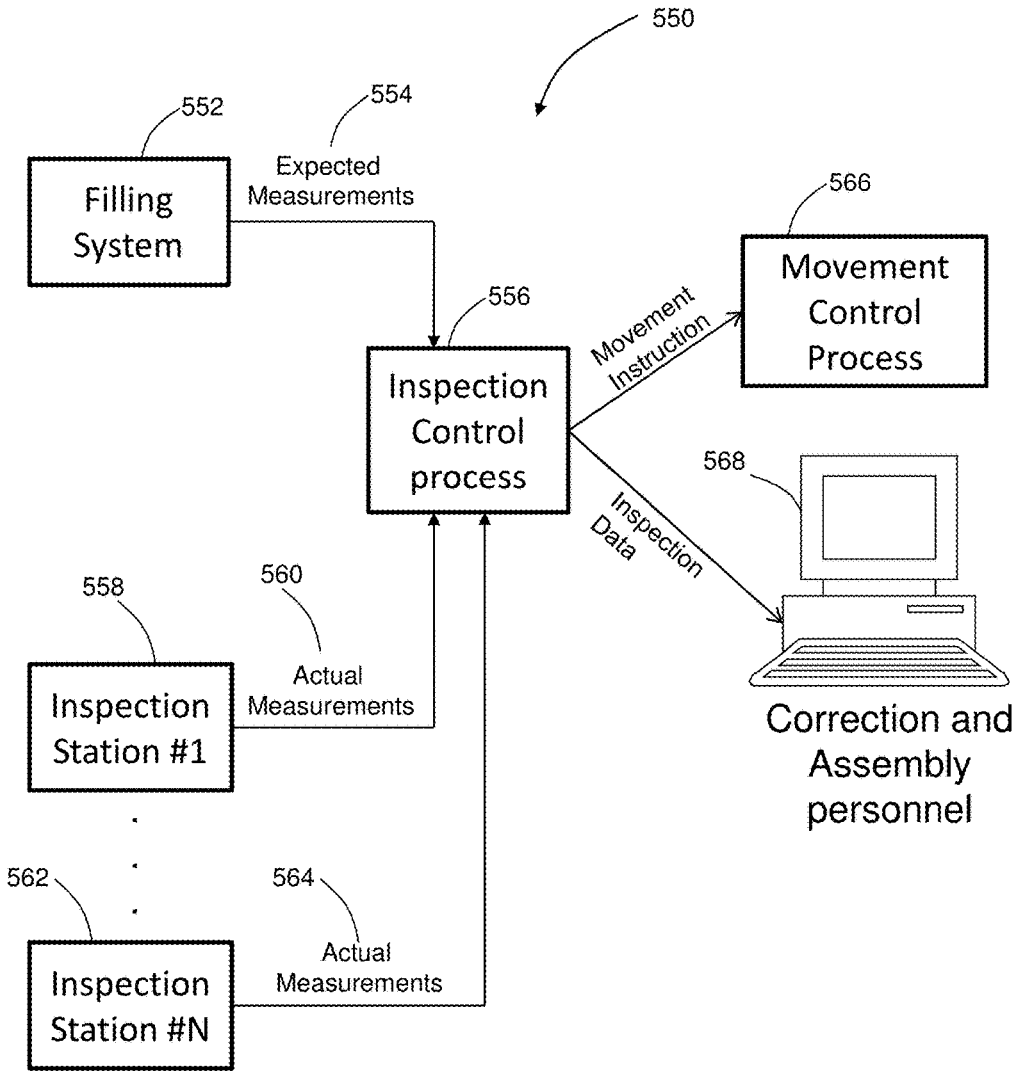

FIG. 8 shown a stand-alone inspection control process system.

Figure 9A:
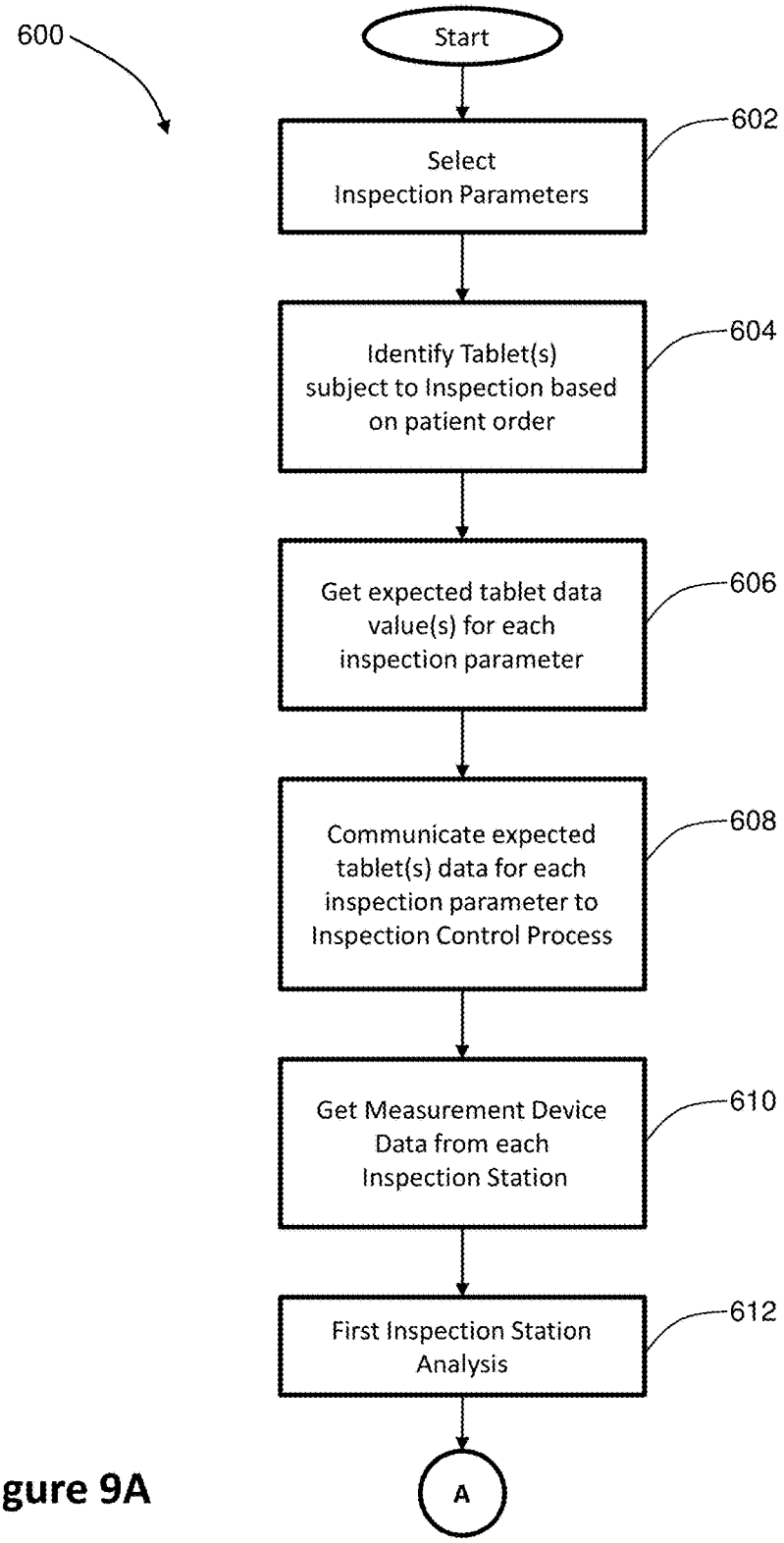
Figure 9B:
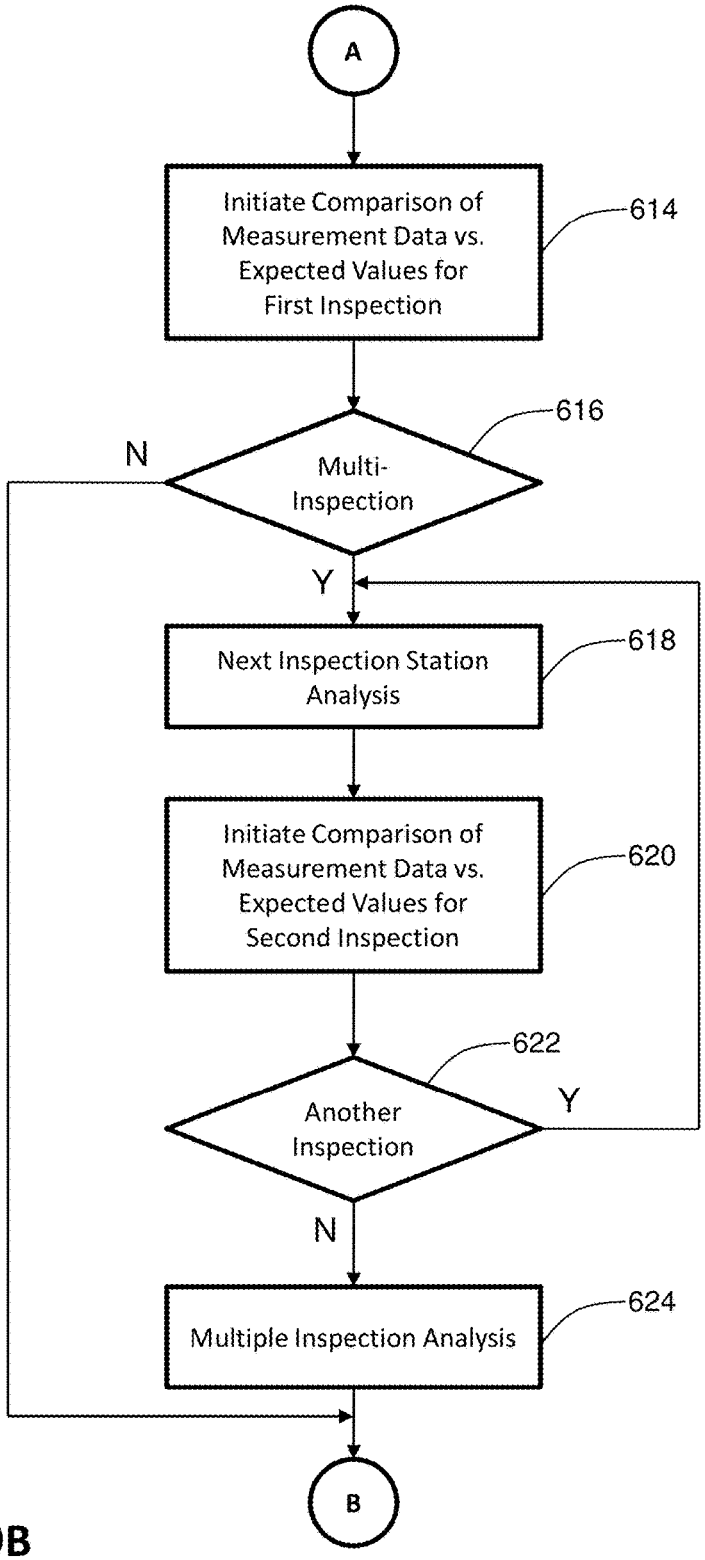
Figure 9C:
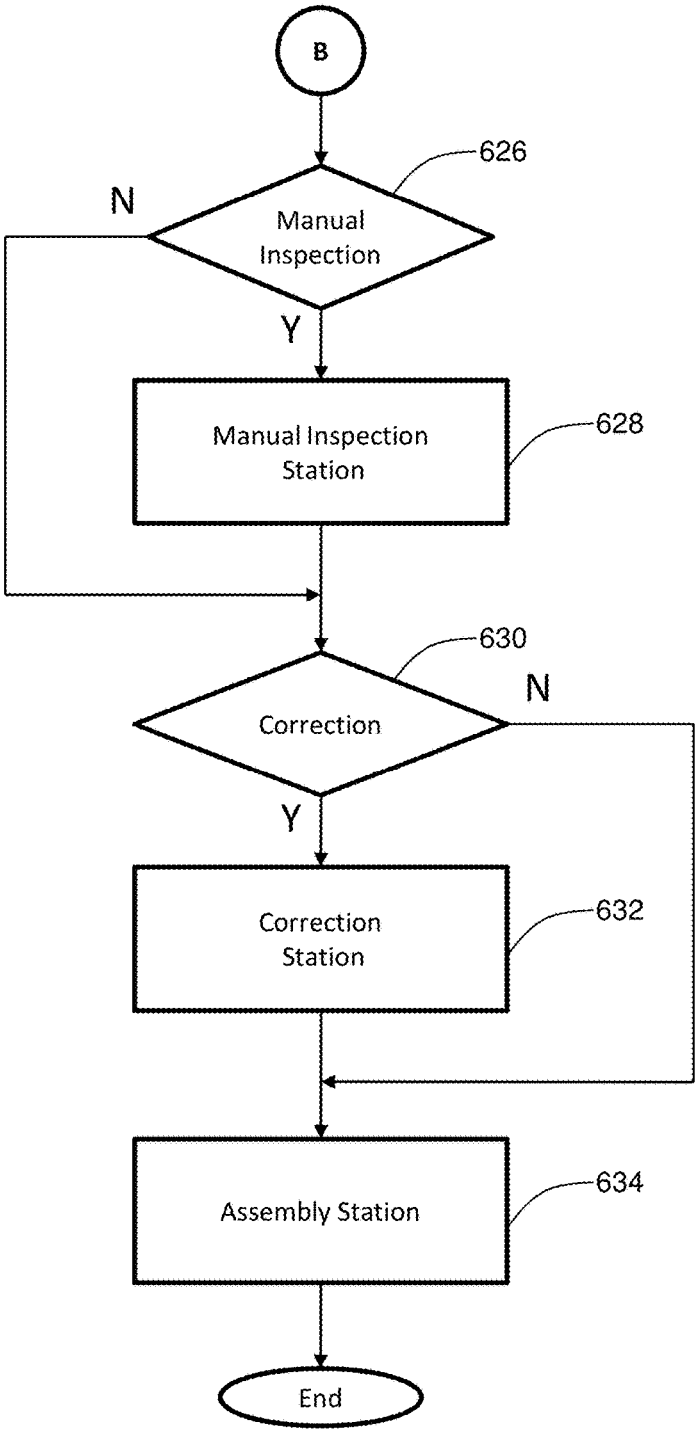

FIGS. 9A-9C shows an inspection and multi-inspection method that inspects preliminary packages that include one or more medications.

FIG. 10 shows a decision table for the multi-inspection analysis of two inspection stations.

Figure 11:
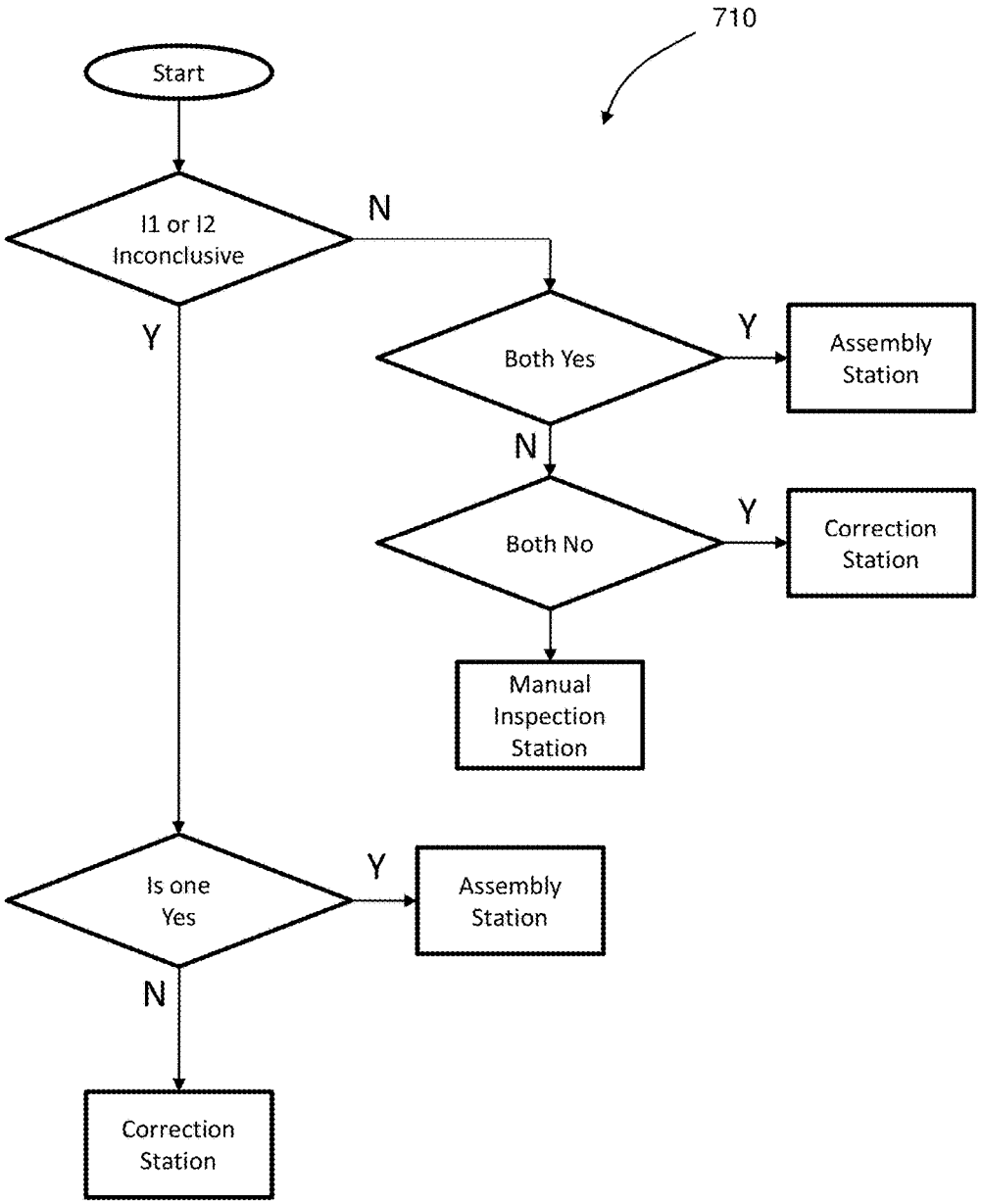

FIG. 11 shows a sequential flowchart of the decision table in FIG. 10.

DESCRIPTION

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the systems and apparatus described hereinafter may vary as to configuration and as to details. Additionally, the methods may vary as to details, order of the actions, or other variations without departing from the illustrative methods disclosed herein.

An inspection system and method is described that assures proper packaging of multiple medications into individualized, time-specific packages. More particularly, the inspection system includes an inspection control process that coordinates the various aspects of a single inspection process, a multi-inspection process, and post-inspection processes.

The medications include, but are not limited to, pharmaceuticals, nutraceuticals, vitamins, supplements, tablets, caplets, capsules, with prescription, without prescription, and any other medication that can be packaged in a preliminary package, package, or container. For purposes of the illustrative embodiments presented herein, the terms medication and tablets are used interchangeably.

For purposes of this patent, the terms preliminary package, package and container are used interchangeably. Illustrative preliminary packages include a pouch, blister, vial, or any package that holds or houses a plurality of different medications. A preliminary package may exist in a sealed preliminary package, e.g. pouch, or an unsealed preliminary package, e.g. blister. The preliminary packages are then placed into a "final" package such as a box container or sleeve.

The illustrative inspection systems and methods described herein include multiple inspection stations, in which each inspection station generates an inspection result state that is analyzed by a multi-inspection analytical module. In one embodiment, the multi-inspection analytical module is associated with an inspection control process module.

In general, the inspection station compares the expected medication value to the measured medication value to generate an inspection result state. The inspection result state includes a positive inspection result state, a negative inspection result state, and an inconclusive inspection result state. The inspection result state may be associated with identifying that a tablet or medication is broken, compromised, or there are too many tablets being dispensed at one particular time in a particular package.

At least two inspection result states are then analyzed by the multi-inspection analytical module. The multi-inspection analytical module then proceeds to select one of a plurality of post-inspection states that convey the package to one of a manual inspection station, a correction station, or an assembly station.

By analyzing two or more inspection processes, the systems and methods described herein reduce the uncertainty about the correctness of the container filling and improve accuracy. The two or more inspection processes may be physically combined in the same housing or may operate as separate physical inspection stations. In the illustrative embodiment, the multiple inspection analysis operates by using a decision table to determine the post-inspection state.

The inspection may be conducted by measuring the physical characteristics of tablets using analytical methods, including but not limited to, 2D visual light sensor (camera or video), 3D visual light sensor, precision weighing, X-ray, near infrared, magnetic resonance imaging, ultrasound, laser excitation, raman spectroscopy, fluorescence spectroscopy, and other such analytical chemical methods. Additionally, precision counting systems that employ a sensor with a photo resistor to detect a light beam broken by a tablet may also be used as an inspection process. Furthermore, an inspection station may be dedicated to identifying RFID codes or other such machine readable representation of data associated with one or more medications or tablets.

The illustrative inspection properties provide quantitative results or qualitative results. Qualitative inspection properties ask the basic question of "what" is present. Quantitative inspection properties ask the basic question of "how much" of each. Qualitative analysis gives an indication of the identity of the chemical species in a sample. Quantitative analysis determines the amount of each compound. Additionally, as described herein algorithmic processes can be applied to qualitative measurements that result in a quantitative value. For example, an optical system relying on visible light performs a quantitative analysis of tablet size, shape and color. An algorithm may then be applied that would count the number of tablets, thereby providing a quantitative measurement.

Figure 1A:
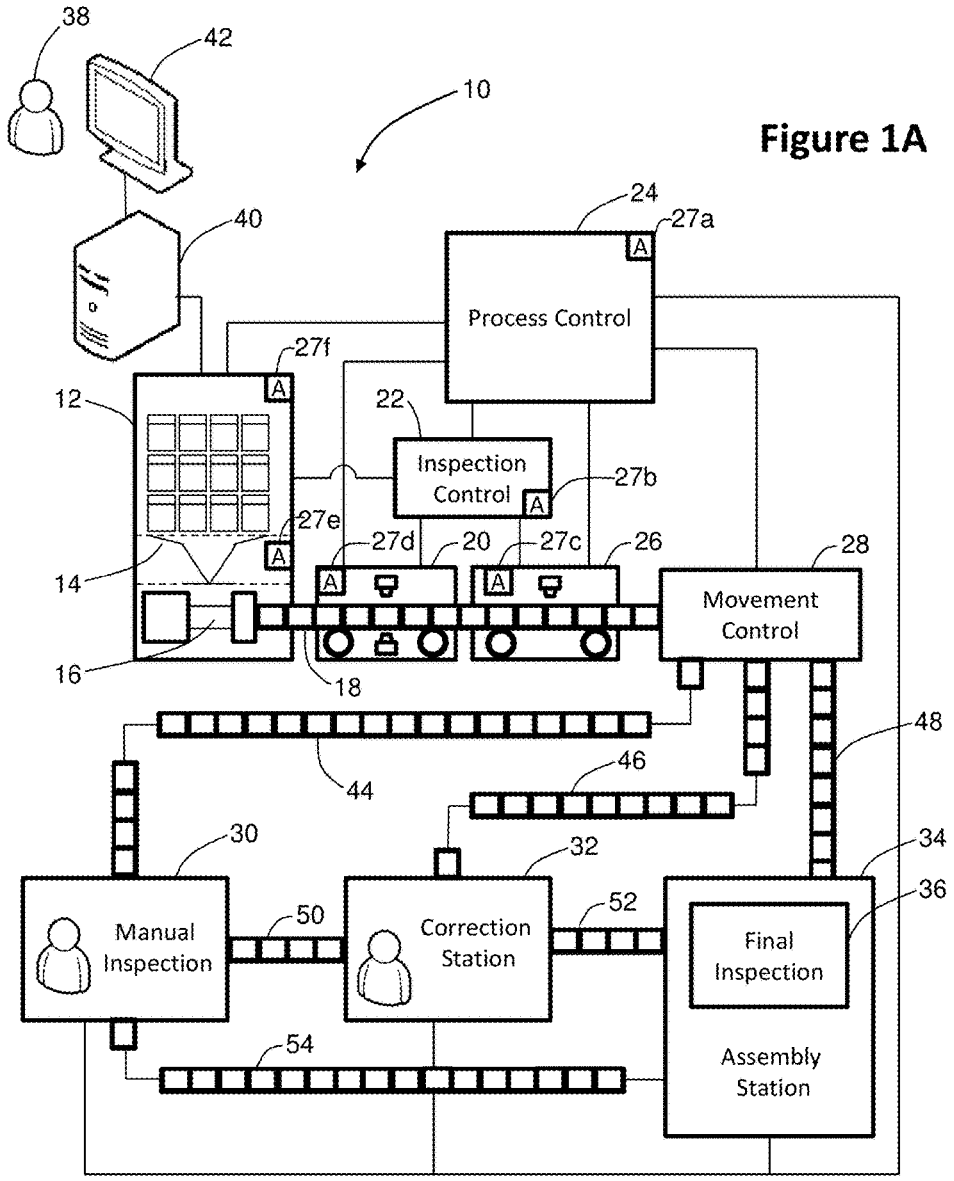
FIG. 1A shows a multiple inspection system for inspecting different medications in a preliminary package.
Figure 1B:
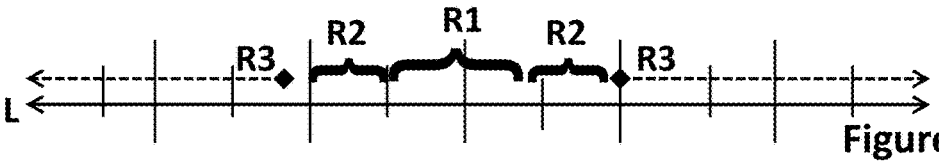
FIG. 1B shows an infinite line with the three states that form a complete set of possible values.

Referring to FIG. 1 there is shown an illustrative multiple inspection system 10 for inspecting different medications in a preliminary package. The multiple inspection system includes an automated filling station 12 that fills preliminary packages with different medications. The automated filling station 12 supplies at least two different medications.

An illustrative first automated inspection station 14 is housed within the automated filling station 12. The illustrative first automated inspection station 14 inspects the tablets before the tablets are placed in the preliminary packages. Alternatively, the first inspection station may be performed after the tablets are placed in the preliminary package.

The illustrative inspection station 14 includes a measurement device that examines the different medications and generates a measured medication value for the different medications. By way of example and not of limitation, the illustrative first automated inspection includes a hopper and a precision weighing device described in further detail in FIG. 3 below. In operation, the hopper catches the tablets and the tablets are then weighed with the precision weighing device. The measured medication value for the illustrative embodiment is the combined weight of the tablets.

An inspection control process module 22 receives the measured medication value (e.g. total weight of tablets) from the first inspection station 14. The inspection control process module 22 is communicatively coupled to the automated filling station 12. In operation, the measured medication value from the first inspection station 14 is received by the inspection control process module 22.

Although the inspection control process module 22 is shown as being separate from the automated filling station 12 housing the first automated inspection 14, the inspection control process module 22 may also be housed within the automated filling station 12. The inspection result state is selected by the inspection control process module 22, which compares the expected medication value to the measured medication value.

In the illustrative embodiment, the inspection result state includes a positive inspection result state, a negative inspection result state, and an inconclusive inspection result state. The three states form a complete set of possible values that are represented by the infinite line L in FIG. 1B. The positive inspection result state corresponds to the measured medication value being a set of values within a small range that approximates the expected medication value represented by R1. The inconclusive inspection result state corresponds to a set of values on either side of the expected medication value range represented by R2. The negative inspection result state corresponds to any measured medication value being outside the range made up of the expected medication value range and the inconclusive inspection result range represented by dashed lines R3.

After the first inspection station 14, a preliminary packaging component 16 receives the multiple medications, combines the multiple medications and places the medications within the preliminary package. In the illustrative pouch embodiment, the pouch is sealed by the preliminary packaging component 16, as described in patent application Ser. No. 11/923,321 entitled A METHOD FOR VERIFYING AND ASSEMBLING A MULTIPLE PRESCRIPTION PACKAGE that is hereby incorporated by reference. For the blister packaging embodiment, the blister is filled with the different medications; the blister may be sealed at the preliminary packaging station or may be sealed at a later time, as described in patent application Ser. No. 11/796,124 entitled MULTIPLE PRESCRIPTION PACKAGE AND METHOD FOR FILLING PACKAGE that is hereby incorporated by reference.

The illustrative filling station 12 inspects the medications that have been placed in the preliminary packages. The type of inspection depends on the particular design of the filling station 12 or inspection station as described above.

A conveyor 18 then receives and conveys the preliminary packages to a second inspection station 20. The illustrative conveyor performs the material handling of transferring goods from one location to another. Conveyance means includes materials handling equipment that conveys goods from one location to another. Illustrative conveyor systems include belt conveyors, wire mesh conveyors, pharmaceutical conveyors, and other such conveyors capable of transferring preliminary packages.

By way of example and not of limitation, the second inspection station 20 performs an optical examination of tablets within sealed or unsealed preliminary packages. The optical examination includes one or more camera or video sensors that capture a plurality of images. The images represent the measured medication value and are qualitative results, i.e. they represent "what" and not "how much." The captured images are then compared to the expected medication value.

The expected medication value for the illustrative optical examination includes a collection of training data or samples that may include "clean" images of each tablet taken under controlled conditions. The clean images are used to establish a full set of values comprising a range, such as that represented by L in FIG. 1B, that can be used for comparison purposes. Additionally, the training data may include a variety of perspective views of the multiple images of each tablet.

An algorithm then analyzes the captured images, i.e. measured medication value, the training data, i.e. expected medication value, and then classifies the captured images as being associated with a particular medication. By way of example and not of limitation, an algorithm can match the size, color, and shape of each medication and obtain a qualitative result.

The algorithms may then be tested to determine an error rate. The error rate is determined based on the number of missed detection or false alarms. A missed detection occurs when samples that are categorized as being "correct" are incorrect. A false alarm occurs when samples are identified as being "incorrect" when they are actually correct. Depending on the weight given to either missed detection or false alarms, missed detections may have a significant impact, whereas false alarms may be costly but are otherwise harmless. Generally, the algorithmic processes described herein are iterative so that there may be modifications to system calibrations, algorithm weighting, and corresponding thresholds.

In the illustrative embodiment, the second inspection station 20 is communicatively coupled to an inspection control process module 22. In operation, the measured medication value from the second inspection station 20 and the expected medication value are received by the inspection control process module 22. The inspection control process module 22 is configured to perform the algorithmic analysis.

The operations of inspection process module 22 may occur in an integrated stand-alone inspection device that is independent of the filling station 12, but is communicatively coupled to the filling station. Thus, in an integrated stand-alone inspection embodiment, the stand-alone inspection station includes the second automated inspection station 20, the measurement device and the inspection control process module 22.

Alternatively, the operations of the inspection process module 22 may be integrated into the filling station 12 (not shown). In this dual inspection filling station embodiment, the filling station performs a first inspection 14 before filling the preliminary package and a second inspection 20 after the preliminary packages are filled.

After performing the optical examination and analyzing the measured medication value (captured images) and the expected medication value (training data), an inspection result state is selected by the inspection control process module 22. The inspection result states include a positive inspection result state, a negative inspection result state, and an inconclusive inspection result state.

The inspection control process module 22 is communicatively coupled to a process control module 24. The process control module 24 controls the movements and interrelationships between the system components and modules. Additionally, the process control module 24 directs the conveyance of the preliminary packages through the filling station, inspection stations, and post-inspection stations.

In the illustrative embodiment, the process control module 24 is communicatively coupled to the automated filling station 12, the first inspection station 14, the conveyor 18, the second inspection station 20, and the inspection control module 22. The process control module 24 controls the conveyance means described herein. Additionally, the process control module 24 conveys the medications according to the inspection result state. Thus, the process control module 24 is configured by hardware and software to provide real-time control and coordination of the various components of the inspection system.

A third inspection station 26 is in communication with the process control module 24. The illustrative third inspection station is an X-ray inspection. By way of example and not of limitation, the x-ray inspection station may operate as described in U.S. Pat. No. 6,324,253 that is hereby incorporated by reference.

The X-ray inspection process is similar to the optical examination described above. For example, the X-ray inspection includes one or more X-ray generators and X-ray detection component that captures X-ray images. Like the optical examination, the captured X-ray images are then compared to the expected medication X-ray images. An algorithm then analyzes the captured images and the training data, and classifies the captured images as being associated with a particular medication.

By way of example and not of limitation, an X-ray algorithm can match the size and shape of each medication and obtain a qualitative result. The optical examination may use color and shape to obtain a qualitative result. This qualitative algorithm may be distinguishable from a quantitative algorithm as described above. The algorithms may then be tested to determine an error rate. The algorithmic processes are iterative so that there may be modifications to system calibrations, algorithm weighting, and corresponding thresholds.

After performing the X-ray examination, an inspection result state is selected by the inspection control process module 22. The inspection result states include a positive inspection result state, a negative inspection result state, and an inconclusive inspection result state. Each of these different states has a range of values that are along a complete spectrum of the possible results in a manner similar to the ranges described with respect to FIG. 1B. Additional inspection stations may also be included in the inspection system described above.

An analytical module 27 then proceeds to perform a multi-inspection analysis that compares the inspection results. The analytical module 27 performs a multi-inspection analysis of two or more automated inspection results for each preliminary package. After completing the multi-inspection analysis, the analytical module 27 selects one of a plurality of post-inspection states that is communicated to the process control module.

In the illustrative embodiment, the analytical module 27 communicates with the process control module 24. The multi-inspection analysis determines the appropriate post inspection state for each package. The post inspection states include a manual inspection station state, a correction station state, and an assembly station state.

The process control module 24 determines where to convey each package according to the multi-inspection analysis and the post inspection state. The post inspection state is communicated to the movement control module 28 that mechanically selects the appropriate post-inspection station.

The manual inspection state results in an instruction to the movement control module 28 to transfer the preliminary package to the manual inspection station 30. Also, the correction station state results in an instruction to the movement control module 28 to transfer the preliminary package to the correction station 32. Additionally, the assembly station state results in an instruction to the movement control module 28 to transfer the preliminary package to an assembly station 34, that includes a final inspection component 36.

In operation, an operator 38 inputs a multiple prescription order through a front-end pharmacy system operating on computer 40 and display 42 that is communicatively coupled to filling station 12. The illustrative software front end is a Pharmaserv™ pharmacy system or EPPA system, as described in patent application Ser. No. 12/896,275 entitled SYSTEM AND METHOD FOR INTEGRATED VERIFICATION AND ASSEMBLY OF MULTI-SCRIPT POUCHES INTO A HOUSING CONTAINER that is hereby incorporated by reference. The operator may be a patient, a caregiver, a nurse, a technician, a pharmacist, physician, or other such person qualified to use front-end pharmacy systems.

The movement control module 28 controls the physical conveyance of the various packages and containers throughout the inspection system 10. Generally, the movement control module 28 is associated with the process control module 24. For illustrative purposes, the movement control module 28 is presented as a separate component that receives the preliminary package from conveyor 18 and selects the manual inspection conveyor 44, correction station conveyor 46, or assembly station conveyor 48.

If the manual inspection conveyor 44 is selected, the preliminary package proceeds to manual inspection 30 where an operator manually inspects the package. The manual inspection operator then decides to convey the preliminary package to either the correction station 32 or assembly station 34 via manual inspection conveyor 50 or manual inspection conveyor 54, respectively. The manual inspection station conveyor 50 transports the manually inspected preliminary packages to correction station 32. The manual inspection conveyor 54 bypasses the correction station 32 and conveys the preliminary packages to assembly station 34. Additionally, the correction station conveyor 52 transfers the corrected preliminary packages to the assembly station 34.

In one embodiment, an instruction from the process control module that the package was improperly filled results in conveying the package to the manual inspection station and then conveying the package to one of the correction station and the assembly station. In another embodiment, the improperly filled instruction conveys the package to the correction station and then the assembly station. In yet another embodiment, a properly filled instruction is received by the process control module, and the package is conveyed to the assembly station.

After completing the post-inspection processes, the assembly station 34 generates the detailed label and other labels having the plurality of written information, as described in patent application Ser. No. 12/424,483 entitled MANUFACTURED SEPARABLE POUCHES WITH A CENTER CUT BLADE that is hereby incorporated by reference. The written information may also comprise packaging information. The written information may comprise information about each substance, appropriate labeling, summary information, a drug interaction report, or a combination thereof.

Figure 2:
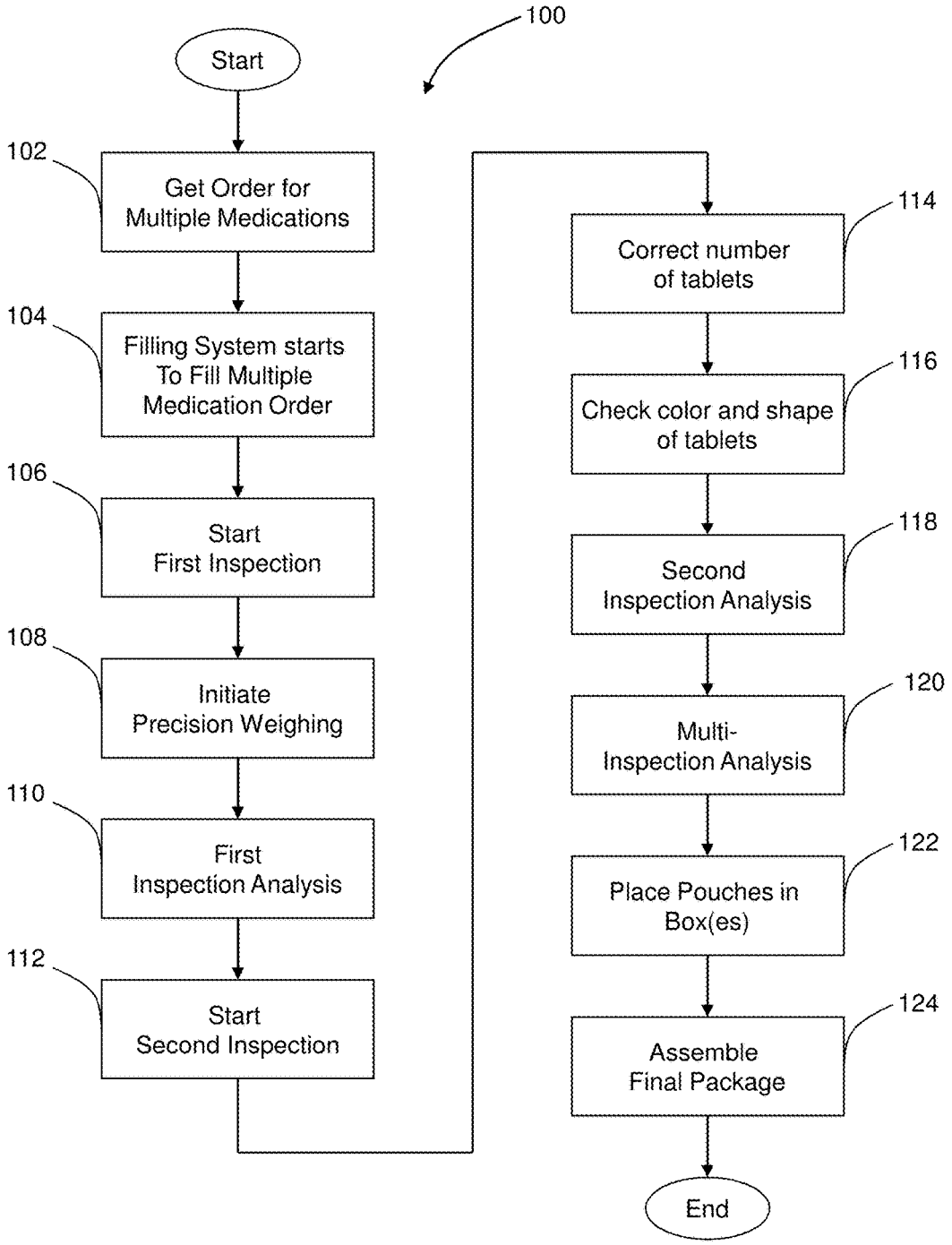
FIG. 2 shows a multiple inspection method that inspects packages filled with at least two different medications that are to be consumed by a particular patient.

Referring to FIG. 2, there is shown a multiple inspection method that inspects packages filled with at least two different medications that are to be consumed by a particular patient. The illustrative method is initiated at block 102 when an order for multiple medications is received by the filling system. In the illustrative embodiment, a verified prescription order is received. The verified prescription order is an order that has been verified according to local jurisdictional requirements, insurance requirements, co-pay requirements, transactional requirements, or a combination thereof. For example, in certain jurisdictions a verified prescription order may require a medical doctor's signature, and may have to be processed by a pharmacist. Additionally, a verified order may require approval from an insurance company, Medicare, or any such entity. In other jurisdictions, the only form of verification may include confirming that funds are available from the particular individual or organization charged, which satisfies transactional requirements. By way of example and not of limitation, verification of the availability of funds may include simply receiving authorization to charge a credit card and confirming that the credit card is a valid card. Alternatively, an order may be received for supplements as described in patent application Ser. No. 12/945,709 entitled SYSTEM AND METHOD FOR ONLINE INTEGRATED MULTIPLE TABLET ORDERING.

At block 104, the filling system starts to fill the multiple medication order. Each package is filled with at least two different medications by the filling station. The filling system is configured to associate at least one package with the patient. The filling process includes placing the medications in a blister package that is unsealed or placing the medications in a pouch that is sealed. Additionally, the blister package may also be sealed in the filling machine.

The method then proceeds to select each package that is to be inspected. In the illustrative embodiment, the process control selects the package and the inspection process. The process control module is communicatively coupled to the filling station.

At block 106, the first inspection is initiated. The first inspection may be qualitative or quantitative. By way of example of not of limitation, the illustrative first inspection step is a precision weighing process as shown in block 108.

The first automated inspection is initiated by examining the different medications with a first measurement device that is associated with a first inspection property. Subsequently, a comparison of a first expected inspection value with the first measurement result generates the first inspection result state.

In the illustrative embodiment, the first inspection analysis is performed by the inspection control process 22 at block 110. As previously described, the inspection control process module 22 receives the measured medication value from the first inspection station 14. Additionally, the expected medication value is received by the inspection control process module 22. The inspection result state is then selected by the inspection control process module 22. The inspection control module compares the expected medication value to the measured medication value to generate the inspection result state, which includes a positive inspection result state, a negative inspection result state, and an inconclusive inspection result state.

As previously described, the positive inspection result state corresponds to the measured medication value being within a range approximating the expected medication value. The negative inspection result state corresponds to the measured medication value being outside a range approximating the expected medication value by a defined amount. The inconclusive inspection result state corresponds to comparison between the measured medication value and the expected medication value being inconclusive and is outside the range approximating the expected medical value, but not so much that it can be determined to be a negative inspection result.

At block 112, the second automated inspection is initiated by examining the different medications with a second measurement device that is associated with a second inspection property. A second measurement result is generated. By way of example and not of limitation, the second inspection process is a visual inspection process.

The illustrative method then proceeds to block 114 where the correct number of tablets is determined. The correct number of tablets is a quantitative measurement result.

At block 116, the illustrative method determines the color and shape of the tablets. The determination of color and shape is a qualitative measurement result.

A second inspection analysis is initiated at block 118. The second inspection analysis generates a second automated inspection result by comparing a second expected inspection value with the second measurement result as described above. A second measurement result is then generated. The method then proceeds to determine a second automated inspection result state by comparing a second expected inspection value with the second measurement result. Again, the second inspection result state includes a positive inspection result state, a negative inspection result state, and an inconclusive inspection result state as described above.

Additional inspection steps may follow the second inspection as described herein. Thus, a third inspection as represented by inspection station 26 may follow. Furthermore, a fourth inspection such as final inspection 36 may also be performed. For example the fourth inspection, namely, final inspection station 36 may perform the scanning or identification of the bar codes for each preliminary package that is associated with the various labels and secondary container housing the preliminary packages.

At block 120, a multi-inspection analysis is performed by an analytical module 27. At a minimum, the analytical module 27 compares and then analyzes the first automated inspection result and the second automated inspection result for at least one package. Based on this analysis, the analytical module 27 selects one of a plurality of post-inspection states that are then communicated to the process control module. The post-inspection states include the manual inspection station state, the correction station state, and the assembly station state; each corresponding with the manual inspection station 30, correction station 32, and assembly station 34, respectively.

After the multi-inspection analysis, the selected post-inspection state is communicated to the process control module 24 that is communicatively coupled to the movement control module 28 that controls the conveyance of the preliminary package to the appropriate post-inspection station.

For example, the process control module 24 may receive an instruction that a particular preliminary package was improperly filled and that the preliminary package is to be transferred to the manual inspection station 30, then correction station 32 and finally to the assembly station 34.

In another example, the process control module 24 receives an instruction that the package was filled improperly and the package is transferred to the correction station 32 and then the assembly station 34.

In yet another example, the process control module 24 receives an instruction that the preliminary package was properly filled and the package is conveyed to the assembly station 34.

At block 122, the assembly station 34 begins the process of placing the preliminary packages in the illustrative box container. In the illustrative embodiment, the illustrative box container is configured to accommodate a 30-day supply of medication. The box container is also configured to receive a label that indicates the time of day or interval during which the medications within the pouch are to be consumed, e.g. morning, noon, evening, or bedtime. The illustrative box container is then glued or sealed.

The final package is then assembled at block 124. In the illustrative embodiment, the final package includes three boxes, in which each box is associated with a particular time of day. The illustrative time of day include morning, noon and evening. Additionally, the final package may include package inserts or a patient information sheet (PIS) and a detailed label that describes each of the medications.

The final package assembly may be performed by an automated means that reviews the prescription and labels, confirms that the appropriate inspections were performed for each preliminary package, confirms that the appropriate level of review by a pharmacist or technician has been performed, confirms that each container was sealed, and checks to see that the proper package insert was generated. By way of example and not of limitation, the package inserts have detailed information about indications, warnings, precautions, side effects, dosage, administration, and clinical pharmacology. The package inserts may also include summaries of the various medications being taken, and summaries of the side effects, and the associated administration. Although the package inserts are written primarily for a physician and pharmacist, the package inserts may be simplified so that they are easier for patients and caregivers to understand.

In certain instances, the final package may also include the PRN medications. PRN medications are consumed on an as-needed basis. Most often PRN medications are analgesics such as Tylenol®, laxatives, sleeping aids, and similar medications.

The final package may also require shipping labels or other such labels indicating that the final package is ready for pick-up. After the final package is validated, the final package is released and is ready for pick-up or shipping.

Figure 3:
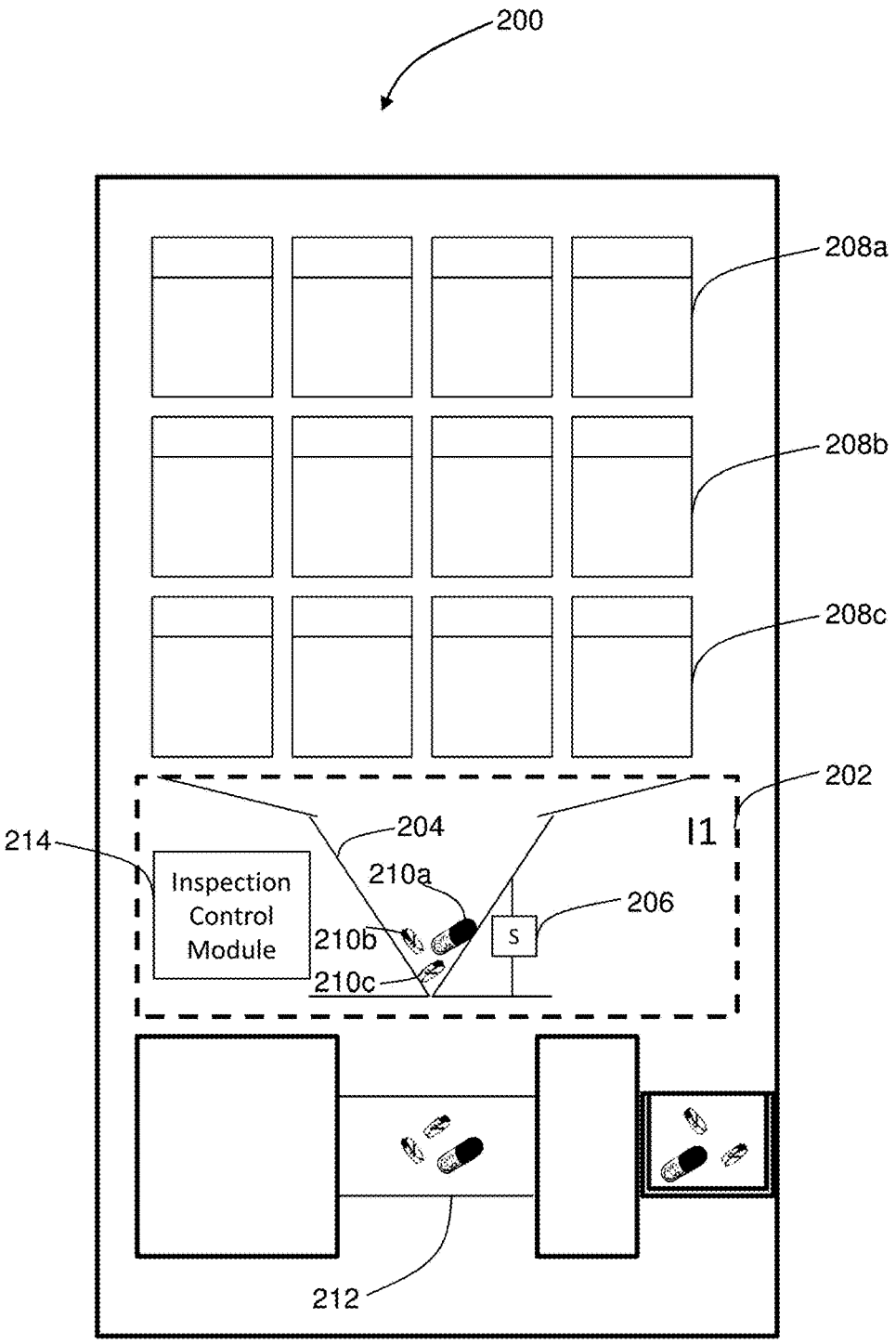
FIG. 3 shows an illustrative filling station that includes a first inspection station.

Referring to FIG. 3, there is shown an illustrative filling station 200 that includes a first inspection station 202. More particularly, the first inspection station 202 includes a hopper 204 and a precision weighing sensor 206, e.g. a scale. The hopper 204 captures the tablets released by re-fill modules 208. At the bottom of the hopper 204 is an electronically controlled a mechanism (not shown) that is configured to close the opening at the base of the hopper 204.

For example, re-fill modules 208*a*, 208*b* and 208*c* each release one tablet 210*a*, 210*b*, and 210*c*, respectively, that are captured by hopper 204 and then weighed by precision weighing device 206. When the tablets have settled in the hopper 204, the precision weighing sensor determines the weight of the hopper 204 and tablets 210. After subtracting the weight of the hopper 204 and associated components supported by the sensor 206, the weight of the tablets 210 is determined and communicated to inspection control module 214. After the weighing process has been completed, the hopper is opened and a preliminary packaging component 212 receives the tablets.

An illustrative filling station that may be retrofitted to support the systems and process described herein include the PARATA™ pharmacy automation station, also referred to as the PACMED™ station, in which the consumables sold by the McKesson Corporation. Other filling systems may also be used such as the YUYAMA™ filling technologies. Additionally, similar filling stations configured to provide an automated system for filling a preliminary package may be customized to support the systems and processes described herein.

In the illustrative embodiment of FIG. 3, the inspection station 202 is positioned before the preliminary packaging component 212 seals the pouches. Alternatively, the precision weighing inspection may be performed after the preliminary packaging component 212 seals the pouches.

In addition to automated filling, the filling system or filling station is configured to support generating a machine-readable representation of data for each preliminary package. By way of example and not of limitation, the machine-readable representation of data includes a barcode, matrix (2D) barcodes, radio frequency identification (RFID), or any combination thereof. Thus, the filling system 10 or filling station 200 is also configured to support generating a machine-readable representation that is associated with each preliminary package, which in turn is associated with a particular patient.

Analysis of the measured weight can be accomplished by the inspection control module 214. In one illustrative embodiment a database (not shown) has an entry for each tablet type indicating the nominal weight and the maximum normal variation. With this information, a table for the specific combination of tablets in a given container is constructed.

For example, a preliminary package receives three tablets, namely, tablets 210*a*, 210*b* and 210*c*, and the nominal weights are 100 milligrams, 150 milligrams and 200 milligrams, respectively. If each tablet has a 5% weight tolerance then the expected weight of the three tablets is estimated to range from 427.5-472.5 milligrams. This estimated range represents the expected medication value. In operation, the inspection control module 214 then compares the expected medication value to the measured medication value to generate the inspection result state as described above.

Figure 4A:
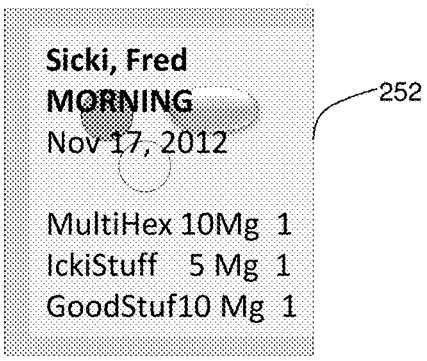
FIGS. 4A-4E shows different preliminary packages and FIG. 4E shows a sleeve that receives the blister preliminary packages.

Referring to FIG. 4A there is shown a pouch 252 that holds multiple medications. The pouch is an illustrative preliminary package. As previously described, the pouch is heat sealed and is generally connected to other plastic pouches that contain similar medications.

Figure 4C:
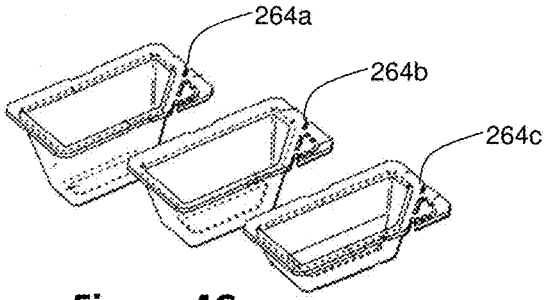
Figure 4D:
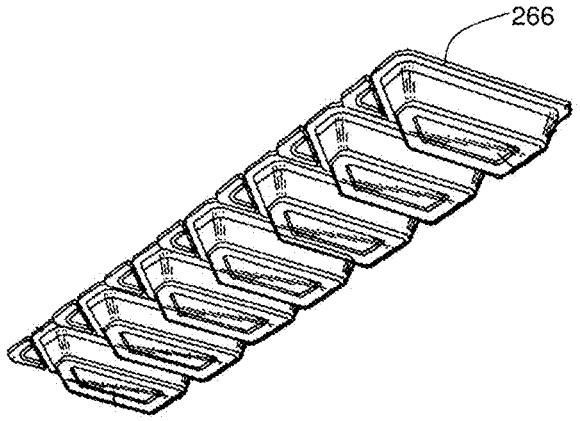
Figure 4B:
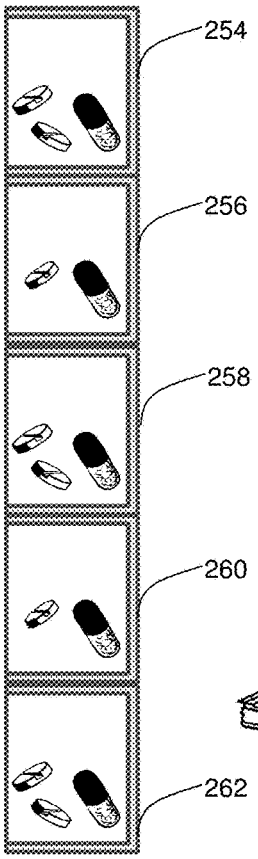

Referring to FIG. 4B there is shown five pouches that are connected to one another, wherein each pouch has different medications and the number of medications differs from pouch to pouch. More particularly, a first pouch 254 holds three tablets, the second pouch 256 holds two tablets, the third pouch 258 holds three tablets, the fourth pouch 260 holds two tablets, and the fifth pouch 262 holds three tablets.

Figure 4E:
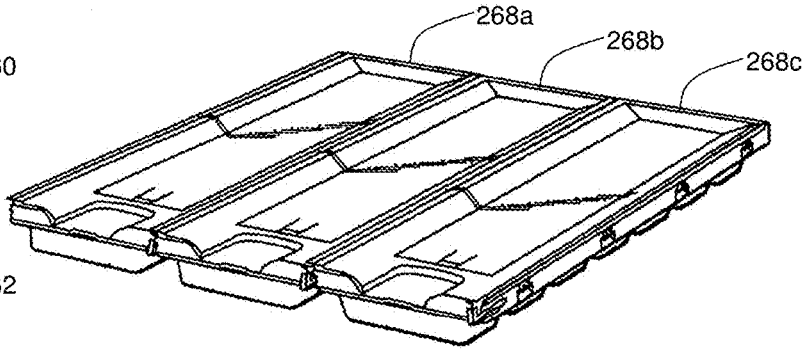

Referring to FIG. 4C there is shown a blister-type preliminary package 264*a*, 264*b* and 264*c* that are each of different size, i.e. height and volume. The blister is a formed plastic component that is configured to receive a removable cover. Each blister is configured to receive multiple medications and provides yet another illustrative embodiment of the preliminary package. Additionally, in FIG. 4D there is shown an isometric bottom view of a seven-day strip 266 of blisters that are adjacent to one another that are received by a sleeve (not shown). In FIG. 4E, illustrative sleeves 268*a*, 268*b* and 268*c* receive the blister preliminary packages are shown.

The preliminary package may be combined with the appropriate secondary containers or "final" package in a child-proof container or in a final package for the visually handicapped.

Figure 5A:
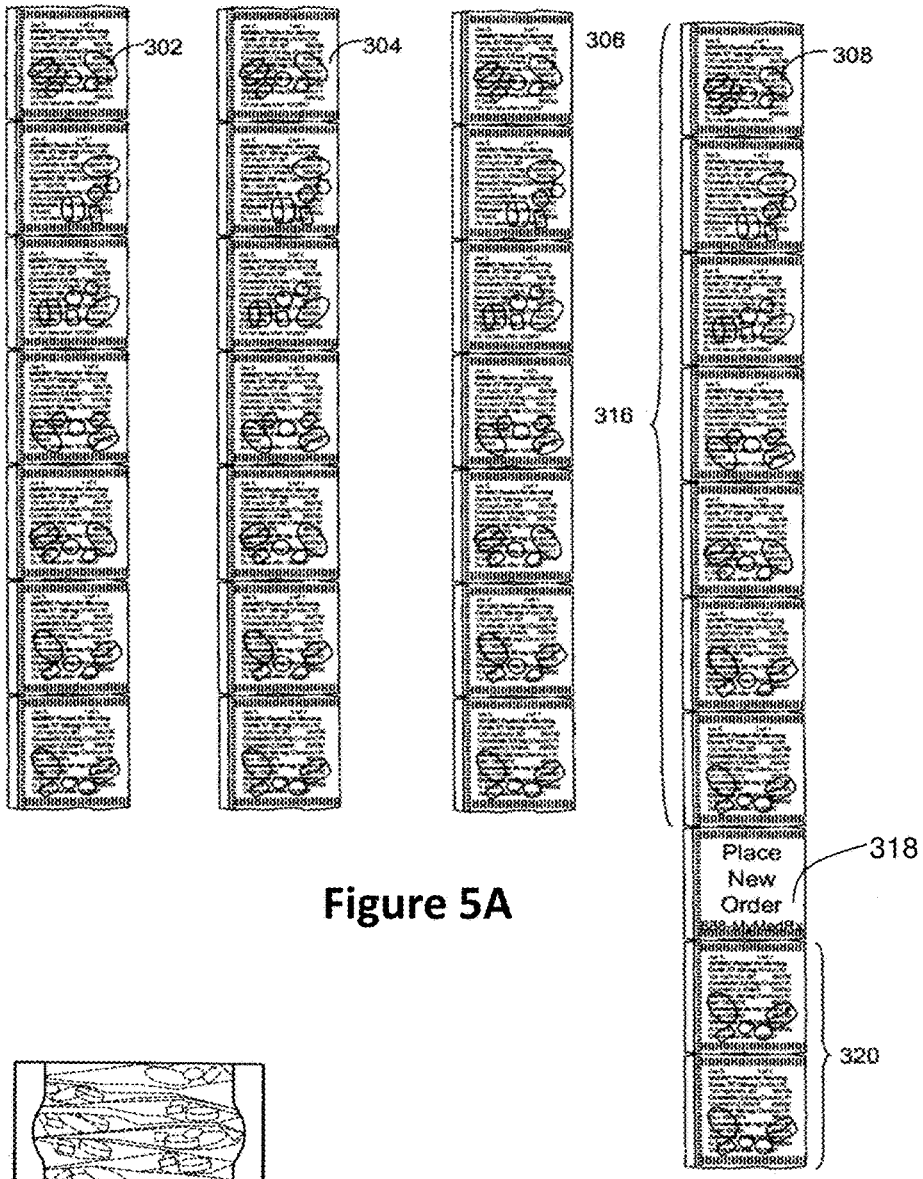
FIG. 5A shows separable sealed pouches in strips grouped together.

Referring to FIG. 5A, there is shown the separable sealed pouches that are grouped together. By way of example and not of limitation, there may be thirty pouches in a single collection that would be combined into the secondary box container shown in FIG. 5B. Alternatively, there may be a collection of seven pouches (for a seven-day box), twenty-eight pouches, or any grouping of pouches.

An illustrative 30-day grouping of sealed pouches may also referred to as a strip, and the terms "strip" and "group of pouches" is used interchangeably in this patent. The number of pouches in a strip may depend on the results of one or more inspections because one of the pouches may be found to be defective. Thus, when a defective pouch is identified, the defective pouch is removed and replaced at the correction station 32 (in FIG. 1), resulting in a separation of the previously connected 30-day grouping of sealed pouches.

In the illustrative embodiment, there are twenty-eight pouches followed by an empty pouch with printing on the pouch to remind the patient and/or caregiver to re-order, and two remaining pouches. Although shown as separate groupings, these separate pouches may be connected to one another and include a 30-day grouping of sealing pouches, in which the first seven-day group of pouches 302 is connected to the second seven-day group of pouches 304 that, in turn, is connected to the third seven-day group of pouches 306 that is also connected to the fourth strip that includes a seven-day group of pouches 308 coupled to an empty pouch that is connected to the two remaining pouches 320.

The empty preliminary package 318 near the end of the sequence of preliminary packages may be empty and have markings that indicate to a patient or caregiver that the consumption of the medications in the preliminary packages is nearly exhausted. Additionally, this empty container can be used to print marketing and/or warning information in lieu of the normal patient information and or description of the medication contents. Examples of such messages might be: "PLEASE REORDER NOW", or "CALL 800-123-4567 TO REORDER NOW", or "CALL JOHN'S PHARMACY TO REORDER NOW".]

Figure 5B:
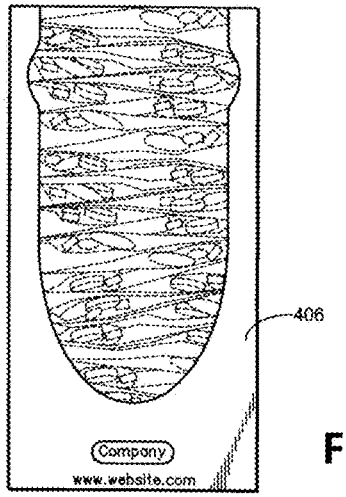
FIG. 5B shows the strips placed into a final box container package.

One or more strips are then placed in a final box container package as shown in FIG. 5B. The terms folded box, assembled box, and container box are used interchangeably to refer to the final package.

In the illustrative embodiment, the dosage period is selected from the group of dosage period intervals consisting of a morning dosage interval, a noon dosage interval, an evening dosage interval, or a bedtime dosage interval.

Figure 6:
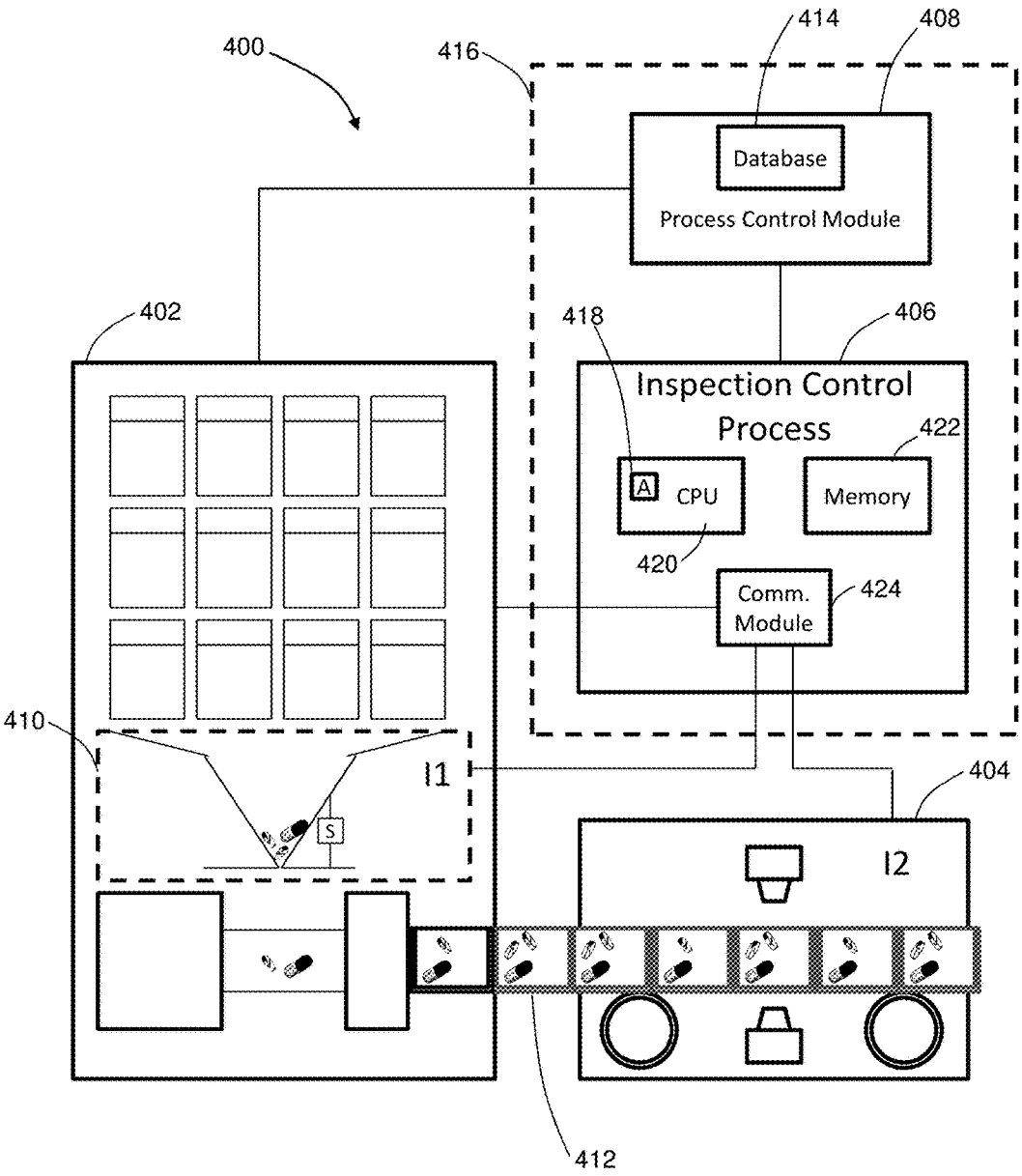
FIG. 6 shows a dual inspection station system.

Referring to FIG. 6 there is shown an illustrative dual inspection station system. The filling system 400 includes a filling station 402, a second inspection station 404, and a centralized inspection control process module 406 that are each communicatively coupled to a process control module 408. The illustrative centralized inspection control process 406 receives raw sensor data from each inspection station and generates a measured medication value. The inspection control process 406 then compares the measured medication value to the expected medication value and generates an inspection result state.

The illustrative filling station 402 is communicatively coupled to the process control module 408 over a data communication network such as a local area network (LAN) using Ethernet and TCP/IP protocols. The process control module 408 is configured to provide real-time control and coordination of the various elements of the filling system 400 including, but not limited to, the filling station 402, the first inspection station 410, the conveyor 412, the second inspection station 404 and the inspection control process 406.

The illustrative filling station 402 passes control data to the process control module 408 and the centralized inspection control process 406. The process control module 408 identifies the medications that are placed into the preliminary packages that are subject to the multiple inspection processes described herein. The process control module 408 also selects each preliminary package that is inspected.

The illustrative filling station 402 communicates information that identifies the patient order associated with each preliminary package for such a patient order. The patient order may be received from a separate pharmacy management system (not shown) that generates an integrated order for processing as described above.

In the illustrative embodiment, the process control module 408 stores the integrated order information and accesses a medication database 414. The medication database 414 is a relational database management system that includes the expected inspection value for each inspection process that is associated with each medication. The illustrative database attributes include tablets weights and variances, color training data parameters, shape training parameters, tablet size data, tablet text information, qualitative values, quantitative values, and other such attributes that are capable of being stored in the medication database 414. Although, the database is presented as a sub-component of the process control module, the medication database 414 may be stored in the filling station 402, the pharmacy management system (not shown), or in any other memory module that is accessible to the illustrative process control module 408 via the illustrative LAN described herein.

In the illustrative embodiment, the process control module 408, the medication database 414, and the centralized inspection control process module 406 are disposed within stand-alone housing 416.

The centralized inspection control process 406 is communicatively coupled to both the first inspection station 410 and the second inspection station 404. The inspection control process receives raw inspection values from each medication value and generates a measured medication value. The "raw" values passed to the centralized inspection control process module 406 are then subjected to measurement techniques that analyze the signal/noise characteristics of the raw values, remove anomalies, filter the data, and perform other such analytical measurement techniques. As a result, the raw sensor data is converted to a measured medication value.

The inspection control process module 406 then compares the measured medication value to the expected medication value and generates an inspection result state.

An analytical module 418 associated with the inspection control process module 406 receives one or more inspection result states, analyzes the inspection result states, and selects a post-inspection state corresponding to one of a manual inspection station (not shown), a correction station (not shown) and an assembly station (not shown). The illustrative analytical module 418 is a software program that runs on a CPU 420 that is electrically coupled to memory 422. A communication module 424 enables the CPU to communicate instructions to the filling station 402, the first inspection station 410, the second inspection station 404, the conveyor 412, the process control module 408 and the database 414.

The illustrative analytical module 418 uses a decision table algorithm, as shown in FIG. 10. For example, a manual inspection may only occur when there is a direct conflict between the results of inspection station #1 and inspection station #2, i.e. one positive inspection result and one negative inspection result. The decision table algorithm may be embodied in a control system, software, hardware, field programmable gate array, CPU, memory, and other such microprocessors and peripherals that are programmable, including a standard PC architecture or embedded equivalent. For illustrative purposes only, the sequential logic for the decision table algorithm of FIG. 10 is present in FIG. 11.

Figure 7:
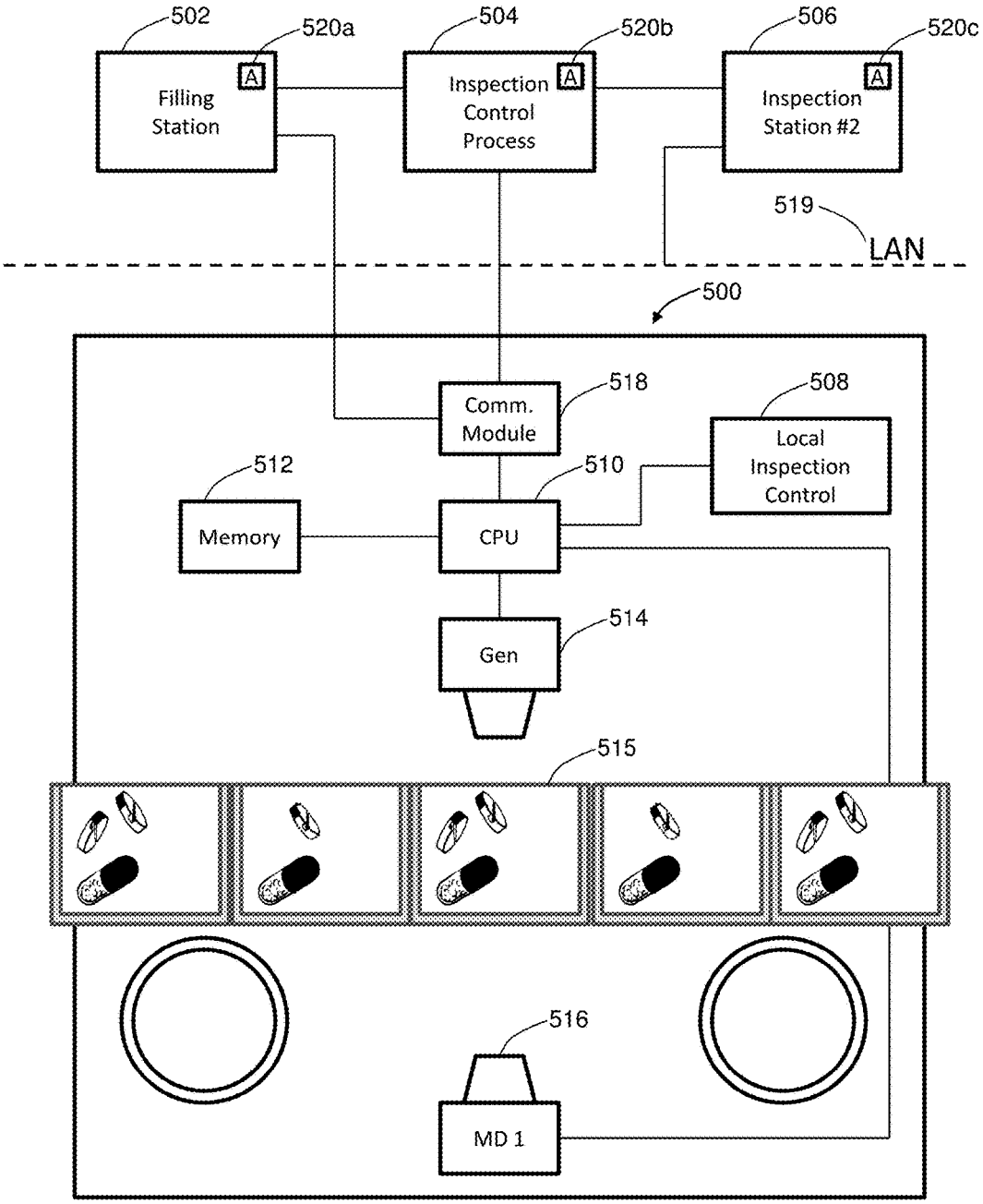
FIG. 7 shows an inspection station with local inspection control.

Referring to FIG. 7, there is shown an illustrative inspection station 500 with local inspection control. The inspection station 500 is communicatively coupled to filling station 502, inspection control process module 504, and another inspection station 506. The illustrative inspection station 500 includes a local inspection control module 508. In the illustrative embodiment, the local inspection control module 508 is a software module, in which instruction processing is performed by CPU 510 performing read/write operations in memory 512. The CPU is also communicatively coupled to a generator 514 and a measuring device 516. An illustrative generator 514 may include a diffuse visible light source, an X-ray generator source, or other such device that operates as an electromagnetic source, or sonic pressure wave source. The illustrative measuring device 516 provides a detection system that produces a raw detected value.

In operation, an illustrative pouch 515 is passed between the generator 514 and the measuring device 516. A raw value is collected by the measuring device 516 that is then communicated to the CPU 510. By way of example, the raw value is a raw visual image(s), raw X-ray images, tare weight or any other such raw value that has not been subjected to the post-processing. The local inspection control module 508 performs the post-processing that generates a measured medication value. The measured medication value is then communicated via the communications module 518 and local area network (LAN) 519 to either the filling station 502, the inspection control process module 504 or to the other inspection station 506. An analytical module 520*a*, 520*b*, and 520*c* disposed in one of the filling station 502, inspection control process module 504, and next inspection station 506, respectively, performs the multi-inspection analysis as described herein.

Referring to FIG. 8, there is shown an illustrative embodiment of a stand-alone inspection control process system 550. The illustrative inspection control process system 550 includes a filling system 552 that communicates an expected measurement value 554 to an inspection control process module 556. The inspection control system 550 also includes an inspection station 558 that communicates an actual measurement value 560 to the inspection control process module 556. Additionally, more than one inspection station 562 can transmit actual measurement values 564 to the inspection control process module 556.

The inspection control process 556 includes logic embodied as hardware, software, or both, that performs a decision making process for each preliminary package. The illustrative decision making process is based on determining a likelihood that a preliminary package is filled correctly or incorrectly.

In operation, the inspection station 558 measures a physical property that corresponds to the preliminary package and communicates these actual measurements to the inspection control process module 556. The inspection control process module 556 also receives information from the illustrative filling system 552 that includes the expected measurements of the intended contents of each preliminary package that is subjected to an inspection. Alternatively, a database (not shown) may be accessed that includes a list of medications associated with the preliminary packages and the corresponding physical characteristics of each of these medications.

For example, the filling system 552 may pass data to the inspection control process module 556 that Tablet A and Tablet B are intended to be in the container under inspection. If the inspection process logic used the weighing of the tablets in the container, the inspection control process module 556 may access a database of all potential tablets that includes information that Tablet A has a weight between 200 and 210 milligrams, and Tablet B has a weight between 300 and 320 milligrams. The inspection control process module 556 determines the contents of the filled container have an expected measurement weight between 500 and 530 milligrams. The expected measurement weight and the actual measurement weight are analyzed by the inspection control process module 556 to determine whether the preliminary package has been properly filled.

In one embodiment, the inspection control process module 556 is a stand-along logic element.

In another embodiment, the inspection control process module may be integrated into another process within the system including, but not limited to, the filling system 552, the first inspection station 558, another inspection station 562, or any other system, module, or component that is communicatively coupled to the inspection control process module 556. For example, the expected measurement weight 554 could be transmitted from the control process 556 or filling system 552 directly to the inspection station 558. The inspection station 558 could then return a simple value to the control process module 556 indicating that the actual weight is consistent with the expected weight, or the actual weight is not consistent with the expected weight.

Inspection accuracy is improved with additional inspection stations. And the inspection control process module 556 may include the analytical module that performs the multi-inspection analysis. Multiple inspections improve the accuracy of inspection process. For example, although the weight of the medications may be accurate, one of the tablets may be broken in two or one of the tablets may have been accidentally replaced with a different tablet of the same or similar weight. A second inspection process that uses a different inspection process, e.g. visual inspection with visible light, can be used to supplement the findings from the first inspection station. Thus, an optical inspection process may be capable of counting the tablets in the preliminary package, or determine the color and shape of the tablets. An error in the tablet count (as in the case of the broken tablet) enables the control process module 556 to identify the preliminary package as being improperly filled. Other inspection processes as described herein may also be used.

In addition to identifying improperly filled preliminary packages, the inspection control process module 556 also has the capability of marking an improperly filled preliminary package. In one embodiment, the filling process is stopped until a corrective action is taken by a human. In another embodiment, the inspection control process module 556 may physically mark an improperly filled or suspect container. If the filling system is sufficiently automated and includes a conveyor system, the inspection control process 556 may pass information to the process movement control module 566 that the improperly filled preliminary package and those preliminary packages associated with the same integrated order are to be routed to a correction station before final order assembly.

Furthermore, the illustrative inspection control process module 556 is also communicatively coupled to a personal computer 568 that is accessible by correction and assembly personnel. The personal computer 568 displays the results of all inspections and analysis available to a technician. The inspection control process module 556 generates a record of all the inspection results and analysis associated with each patient order. The records can be used for data inquiry or to generate more detailed historical reports.

The illustrative movement control process 566 may be embodied as a software process in a standard PC with UNIX or Microsoft Windows as an operating system. The movement control process 566 may have access to a Microsoft SQLServer database with records for each potential tablet type, and associate physical properties with each tablet that are appropriate to the type of inspection devices that are implemented in the system. Communication of information between the various processes could be accomplished with any of a variety of messaging mechanisms provided in various operating system environments. A separate utility program would be used to maintain that database and update it periodically as tablets are removed or new tablet types are introduced or new generic versions of tablets are added to the system.

Referring to FIG. 9A-9C there is shown an illustrative inspection and multi-inspection method that inspects preliminary packages that include one or more different medications. The method is initiated at block 602 wherein inspection parameters are selected by one of the inspection control modules or inspection stations described above.

The method then proceeds to block 604 where tablets are identified for inspection. The tablets are selected by an automated filling system that receives a verified and integrated patient order. A preliminary package is filled with the multiple medications that generally include tablets.

As described above, each inspection station receives at least two medications in at least one preliminary package. At block 606, the expected tablet values for each inspection parameter are received by the either the inspection station or the inspection control process module.

In the illustrative embodiment, the expected tablet data for each preliminary package are communicated to the inspection control process in block 608. As previously described, the expected tablet data corresponds to one or more inspection parameters. The method then proceeds to block 610 where the measurement data from an inspection station is received. As previously described, the inspection station includes a measurement device that corresponds to the inspection station.

At block 610, the illustrative inspection control process module obtains the measurement device data from each inspection station and a first inspection analysis is completed by the analytical module at block 612. The method then proceeds to block 614, in which a comparison is initiated between the measurement data and the expected values of the first inspection station. Based on this comparison, the illustrative inspection control process or inspection station then proceeds to select an inspection result state. The inspection result state includes a positive inspection result state, a negative inspection result state, and an inconclusive inspection result state.

At decision diamond 616, a determination is made to perform a multi-inspection analysis. A multi-inspection analysis may not be necessary and so the multi-inspection process can be bypassed to expedite the processing and handling of the patient order. For example, a single tablet may be carried in a particular preliminary package or single type of tablet may be placed in a particular pouch. As a result, a single inspection process may be satisfactory such as the precision weighing process described above.

When a preliminary package having multiple different medications is received, a decision to proceed with a multiple inspection process is made at decision diamond 616. At block 618, the second inspection analysis is performed. The illustrative second inspection is an optical inspection that analyzes the size, shape and color of each tablet. At block 620, an inspection step compares the measurement data from the second inspection station to the expected values that corresponds the second inspection station.

The determination to perform another inspection is made at decision diamond 622. If the decision is to perform another inspection, the method proceeds to the next inspection station. By way of example, the third inspection may be an X-ray inspection process.

If the inspection steps for the selected preliminary package have been completed, the method proceeds to block 624 where a multiple inspection analysis is performed. After the multiple inspection analysis is completed, a determination is made to proceed to the manual inspection station at decision diamond 626. If a manual inspection is necessary, the preliminary package is sent to manual inspection station at block 628.

If the manual inspection is not required, the method then proceeds to determine whether a correction step is necessary as shown in decision diamond 630. If a correction step is needed, the method proceeds to correction station block 632 where the preliminary package is conveyed to the correction station. At block 634, the method then proceeds to the assembly station as described above.

Referring now to FIG. 10, there is shown an illustrative decision table 700 for the multi-inspection analysis of two inspection stations. In column 706, the inspection result states of the first inspection station are presented wherein "good" refers to a positive inspection result state, "bad" refers to a negative inspection result state, and "inconclusive" refers to an inconclusive result state. Each of the inspection result states are described above in further detail. In column 704, the inspection result states for the second inspection station are presented.

The multi-inspection analysis is then performed. In column 702, the decision to convey packages to manual inspection is based on analyzing the inspection results in columns 702 and 704. The decision to convey a package to the correction station in column 708 is also based on analyzed the combined inspection results. An illustrative sequential flowchart 710 of the decision table 700 that may be programmed for a logic controller is shown in FIG. 11.

It is to be understood that the foregoing is a detailed description of illustrative embodiments. The scope of the claims is not limited to these specific embodiments. Various elements, details, execution of any methods, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A multiple inspection method comprising:

filling each package with at least two different medications with a filling station that associates at least one package with a patient, wherein each package includes a plurality of different tablets that are to be consumed at least once a day;

initiating a first automated inspection by examining the different medications in each package with a first measurement device that is associated with a first inspection property;

determining a first automated inspection result by comparing a first expected inspection value with a first measurement result;

initiating a second automated inspection by examining the different medications in each package with a second measurement device that is associated with a second inspection property;

determining a second automated inspection result by comparing a second expected inspection value with a second measurement result; and analyzing the first automated inspection result and the second automated inspection result for at least one package.

2. The multiple inspection method of claim 1 further comprising providing a manual inspection station, a correction station and an assembly station.

3. The multiple inspection method of claim 2 further comprising receiving an instruction that the package was improperly filled and conveying the package to the manual inspection station and then conveying the package to one of the correction station and the assembly station.

4. The multiple inspection method of claim 2 further comprising receiving an instruction that the package was improperly filled and conveying the package to the correction station and then the assembly station.

5. The multiple inspection method of claim 2 further comprising receiving an instruction from a process control module that the package was properly filled and conveying the package to the assembly station.

6. The multiple inspection method of claim 2 further comprising, initiating a third automated inspection by examining the different medications with a third measurement device;

generating a third measurement result;

determining a third automate inspection result by comparing a third expected inspection value with the third measurement result; and analyzing the first inspection result, the second inspection result and the third inspection result with an analytical module that selects one of a plurality of post-inspection station.

7. The multiple inspection method of claim 2 wherein the measurement device is selected from the group consisting of a camera, a video, a precision weighting component, and an X-ray.

8. A multiple inspection system comprising:

a filling station that fills each package with at least two different medications, the filling station associates at least one package with a patient, wherein each package includes a plurality of different tablets that are to be consumed at least once a day;

a first automated inspection station that examines the different medications in each package with a first measurement device that is associated with a first inspection property;

a first measurement result generated by the first automated inspection station;

a first automated inspection result generated by comparing first expected inspection value with the first measurement result;

a second automated inspection station that examines the different medications in each package with a second measurement device that is associated with a second inspection property;

a second measurement result generated by the second automated inspection station;

a second automated inspection result generated by comparing a second expected inspection value with the second measurement result; and an analytical module that analyzes the first automated inspection result and the second automated for at least one package and then selects one of a plurality of post-inspection stations.

9. The multiple inspection system of claim 8 wherein the post-inspection stations include a manual inspection station, a correction station and an assembly station.

10. The multiple inspection system of claim 9 further comprising an instruction that the package was improperly filled, conveying the package to the manual inspection station and then conveying the package to one of the correction station and the assembly station.

11. The multiple inspection system of claim 9 further comprising an instruction that the package was improperly filled and conveying the package to the correction station and then the assembly station.

12. The multiple inspection system of claim 9 further comprising an instruction that the package was properly filled and conveying the package to the assembly station.

13. The multiple inspection system of claim 9 further comprising, a third automated inspection that examines the different medications with a third measurement device;

a third measurement result generated by the third automated inspection;

a third automated inspection result generated by comparing a third expected inspection value with the third measurement result; and the analytical module analyzes the first inspection result, the second inspection result and the third inspection result and select one of a plurality of post-inspection stations.

14. The multiple inspection system of claim 9 wherein the measurement device is selected from the group consisting of a camera, a video, a precision weighting component, and an X-ray.

15. A multiple inspection system comprising:

a filling station that fills each package with at least two different medications, the filling station associates at least one package with a patient, wherein each package includes a plurality of different tablets that are to be consumed at least once a day;

a first automated inspection station that includes, a first measurement device that examines the different medications in each package based on a first inspection property, and a first sensor measurement generated by the first measurement device;

a first inspection result;

a second inspection station including, a second measurement device that examines each package based on a second inspection property, and a second sensor measurement generated by the second measurement device;

a second inspection result; and an analytical module that analyzes the first inspection result and the second inspection result for each package, the analytical module selects one of a plurality of post-inspection stations.

16. The multiple inspection system of claim 15 further comprising a manual inspection station disposed after the second inspection station, wherein the manual inspection station receives an instruction to send the package to one of a correction station or an assembly station.

17. The multiple inspection system of claim 15 further comprising a correction station disposed after the second inspection station, wherein the correction station corrects at least one package, when at least one package is improperly filled.

18. The multiple inspection system of claim 15 further comprising an assembly station that assembles each package into a container, when at least one package is properly filled.

19. The multiple inspection system of claim 15 further comprising, a third automated inspection that examines the different medications with a third measurement device;

a third measurement result generated by the third automated inspection;

a third automated inspection result generated by comparing a third expected inspection value with the third measurement result; and the analytical module analyzes the first inspection result, the second inspection result and the third inspection result and select one of a plurality of post-inspection stations.

20. The multiple inspection system of claim 15 wherein the measurement device is selected from the group consisting of a camera, a video, a precision weighting component, and an X-ray.

* * * * *